United States Patent [19]

Fisher et al.

[11] Patent Number: 4,761,000

[45] Date of Patent: Aug. 2, 1988

[54] SURGICAL TABLE HAVING HORIZONTALLY DISPLACEABLE TABLETOP

[75] Inventors: Kenneth J. Fisher; Eric J. Schuldt; Thomas J. Fendya, all of Erie, Pa.

[73] Assignee: American Sterilizer Company, Erie, Pa.

[21] Appl. No.: 35,674

[22] Filed: Apr. 7, 1987

[51] Int. Cl.[4] ..... A61G 13/00

[52] U.S. Cl. ..... 269/323

[58] Field of Search ..... 108/143, 144, 447, 1, 108/5, 7; 269/322–326; 372/209, 195–196; 5/62, 63

[56] References Cited

U.S. PATENT DOCUMENTS

| | | | |
|---|---|---|---|
| 2,794,694 | 6/1957 | Fullwood et al. | 269/325 |
| 3,240,935 | 3/1966 | Dougall | 378/209 |
| 3,362,704 | 1/1968 | Pilz | 269/325 |
| 3,635,461 | 1/1972 | Bellucci et al. | 269/325 |

FOREIGN PATENT DOCUMENTS

| | | | |
|---|---|---|---|
| 997407 | 4/1973 | Canada | 269/325 |

*Primary Examiner*—Robert C. Watson

*Attorney, Agent, or Firm*—Kirkpatrick & Lockhart

[57] ABSTRACT

A surgical table is provided which is capable of conventional surgical table functions and is provided with a radioluscent tabletop which may be horizontally displaced to allow radiographic procedures to be performed without requiring relocation of the patient. The surgical table includes a base member which may be locked to a floor mount pivot. The base member supports a table superstructure which may be raised and lowered and tilted relative to the longitudinal axis of the table as well as tilted relative to a lateral axis of the table. A carriage assembly is provided intermediate the tabletop and the superstructure which allows the translation of the tabletop both longitudinally and laterally. Locking means are provided to prevent the horizontal translation of the tabletop when the table is in the surgical mode. Control means are provided to select either the surgical mode in which the tabletop is locked to the superstructure or the translation mode in which the tabletop may be translated relative to the superstructure. In the translation mode the table is locked to the floor bracket and the tabletop may be displaced relative to the superstructure. In addition, means are provided for automatically returning the table to a level condition either in the surgical mode or in the translation mode.

9 Claims, 15 Drawing Sheets

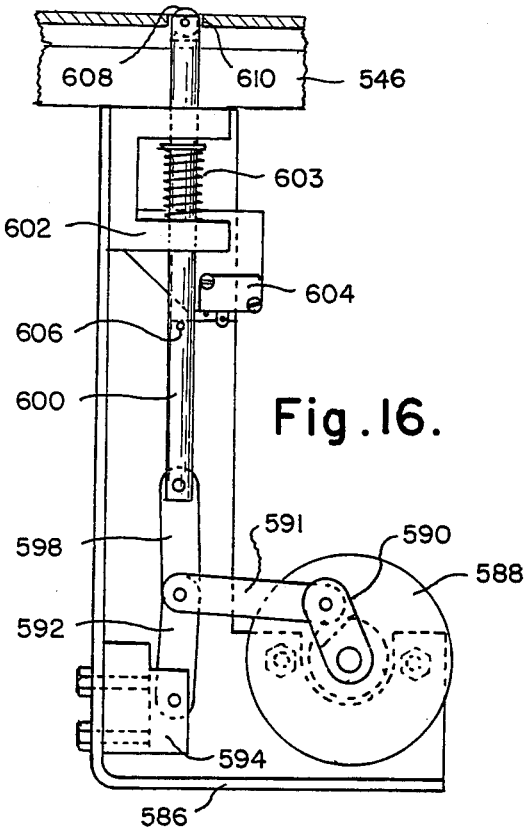
Fig. 16.
Fig. 17.
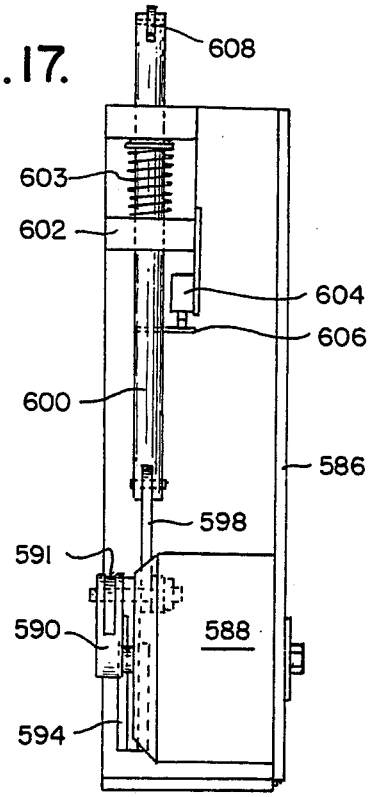
Fig. 15.
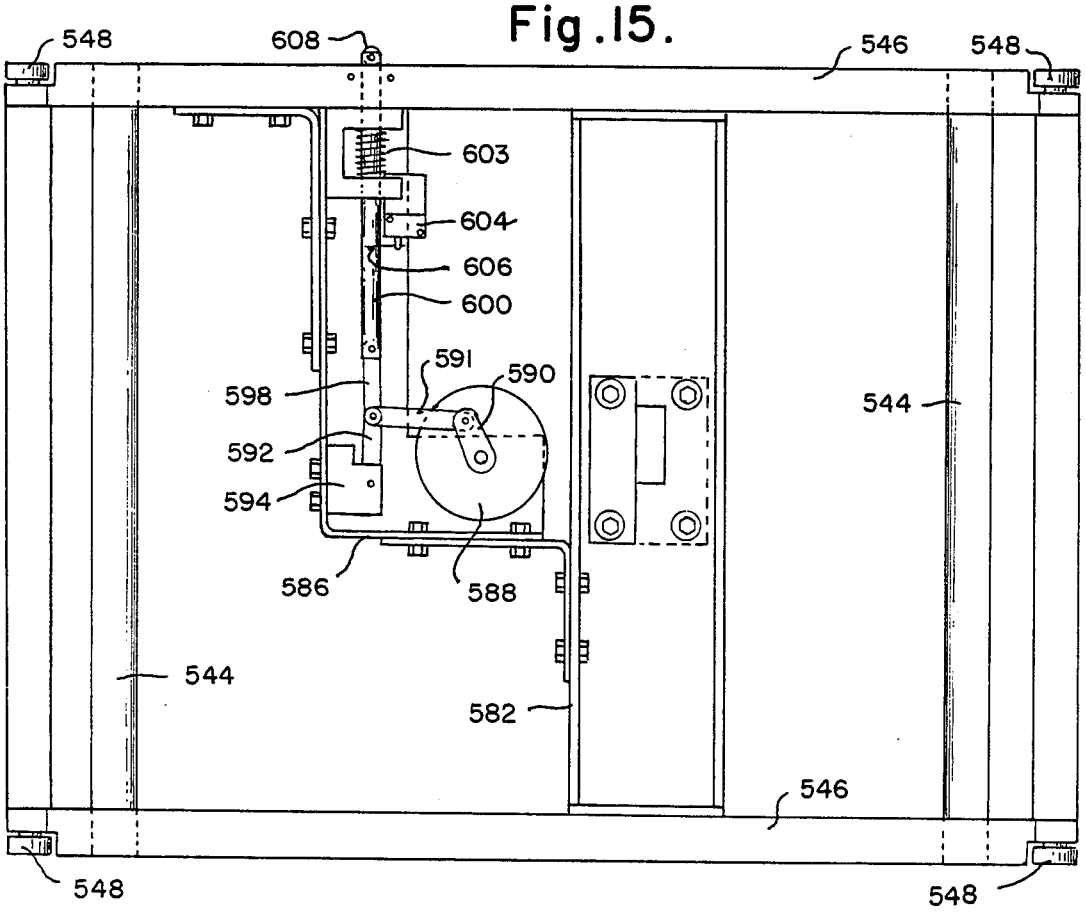

SURGICAL TABLE HAVING HORIZONTALLY DISPLACEABLE TABLETOP

BACKGROUND OF THE INVENTION

Reference is made to the following U.S. patent applications which are filed on the same date as the present application, are owned by the assignee of the present application and relate to inventions which are employed on the same commercial apparatus as this invention: Ser. No. 035,675 and Ser. No. 035,529.

FIELD OF THE INVENTION

The present invention relates to surgical tables and, in particular, to surgical tables which may also be used for radiography and/or radiology.

DESCRIPTION OF THE INVENTION BACKGROUND

Fortunately, medical science has progressed to such a level in recent years that may procedures which are heretofore impossible may now be employed to save human lives. However, the hardware which was commercially available was incapable of allowing the complete performance of available procedures.

In conventional hospital operations, a surgical suite was provided for the performance of major surgery. In addition, a radiology suite was provided to allow physicians to produce radiographic images of areas of the body or to apply radiation to such areas. Each of these suites was, of course, provided with a table on which the respective procedures could be performed.

Conventional surgical tables included a tabletop which was movably mounted on a pedestal attached to a base. Such surgical tables were capable of tilting the tabletop to the right or left of the patient. In addition, conventional surgical tables allowed the tabletop to be tilted about a lateral axis so that the patient's head could be lowered (Trendelenburg position) or the patient's feet lowered (Reverse Trendelenburg position). Further, the height of the tabletop could be adjusted relative to the floor. In certain of such surgical tables, the lateral tilt, longitudinal tilt and raise-lower functions were mechanically powered while in other tables, those functions were manually actuated.

In radiology suites, radiology tables were employed which allowed a tabletop supporting a patient to be moved in a horizontal plane either laterally or longitudinally relative to the massive structure of the radiographic imaging apparatus so that images of the desired area could be produced. Prior radiology tables, therefore, had a tabletop which allowed radiation to pass therethrough relatively unaffected. The horizontal movements of the tabletop were made possible in certain tables by means of supports for the tabletop which allowed manual positioning. Typically, magnetic brakes were provided between the tabletop and the supporting structure to prevent inadvertent movement of the tabletop once positioned. Alternatively, certain radiology tables included powered means for horizontally displacing the tabletop with the mechanical means providing tabletop fixation.

Recent medical procedures have required hybrid tables that provide different types of functions. For example, a procedure requiring the insertion of a catheter into a patient's heart requires a radiology table so that the surgeon can monitor the progress of the catheter. Should the catheter puncture a vessel wall, it might be necessary to immediately operate on the patient. For such an operation, the features provided by a conventional surgical table are desirable.

Also, efforts to keep costs down have forced health care facilities to demand more flexibility from the equipment that they purchase. A dedicated table permanently fixed in a single location does not offer the required flexibility. As such, portability is desired feature of a combination table. Portability of tables also allows the patient to be prepared for the procedure at a remote location, wheeled into the operating theater and, following the procedure, the patient may be moved, while on the table, to a recovery area and another patient wheeled into the theater.

Recognizing some of the benefits of combining the functions of surgical tables with those of radiology tables, attempts have been made to provide apparatus capable of both sets of functions. However, as is explained below, such efforts have not provided apparatus which is satisfactory for the needed purposes. One table produced heretofore combined a powered surgical table with a tabletop which was horizontally movable under the power of electric motors. It will be readily appreciated that such tables were not ideally suited to the performance of radiology because the tabletop movements were slow and most difficult to precisely control, especially in two horizontal directions. In another combination table, a manually operated surgical table base was provided with a tabletop which could be manually horizontally positioned, but only in the longitudinal direction to allow the insertion of the patient within the structure of the imaging apparatus. Those tables did not allow the tabletop to be laterally moved so that the massive radiographic imaging apparatus was required to be moved to perform radiological procedures on parts of the body remote from the tabletop's center line. It was quickly discovered that the movement of the imaging device was difficult and inexact.

The subject invention is directed toward a table for medical use which allows the needed powered movements of surgical tables and which also allows the manual movement of a radioluscent tabletop both laterally and longitudinally, or in combination, and which overcomes the above-discussed problems with other tables.

SUMMARY OF THE INVENTION

In accordance with the present invention, there is provided a table for medical use on which both radiography and major surgery may be effectively accomplished. The table provided includes a base member which may be locked by a solenoid to a floor-mounted pivot bracket which stabilizes the table and which provides electrical power to the table. A pedestal is attached to the base member for supportingly guiding the movement of the superstructure of the tabletop such that it may be raised and lowered by means of a hydraulic cylinder.

The superstructure supports a radioluscent tabletop and includes powered means for causing the tabletop to be laterally tilted and longitudinally tilted. As used herein, the term "surgical mode" will refer to movement of the pedestal and superstructure effective to tilt the tabletop relative to its longitudinal axis and to tilt the tabletop about a lateral axis (sometimes referred to herein as the Trendelenburg mode).

The subject invention also includes carriage means disposed intermediate the superstructure and the tabletop which allows the latter to be freely moved in a horizontal plane both transverse to the longitudinal axis of the tabletop and along such axis. In particular, the carriage means includes rollers mounted on the superstructure which movably support lateral channels to allow lateral displacement of the tabletop and rollers mounted on the lateral channels for movably supporting longitudinal channels affixed to the tabletop to allow its longitudinal displacement. As used herein, the term "X-Y mode" refers to the operating condition of the table in which lateral ("X" direction) and longitudinal ("Y" direction) movement of the tabletop may be accomplished.

In order to positively secure the tabletop against X-Y movement when the tabletop is in the surgical mode (and, hence, prevent the tabletop from "running-away" from the superstructure while supporting a patient) translation locks are provided. A lateral translation lock is attached to the table superstructure and includes a rotary electric solenoid and linkage assembly which causes a plunger to engage a lock catch on the lateral carriage so as to lock the lateral carriage to the superstructure. A longitudinal translation lock is supported on longitudinal channels attached to the lateral carriage and includes a rotary solenoid and linkage assembly which causes a plunger to engage a notch in the longitudinal carriage to lock that carriage to the lateral carriage.

In accordance with the present invention, there is also provided apparatus for automatically leveling the tabletop. The self-leveling means includes inclinometers mounted on the superstructure which sense whether the tabletop is level and, if not, to adjust the tilt and Trendelenburg drive motors to return the table to a level condition. When in the surgical mode, if the tabletop has been laterally and/or longitudinally tilted, the self-leveling means is effective to return the tabletop to a level condition. Also, when the tabletop is in the X-Y mode and the tabletop has been translated to a great extent in the longitudinal direction, due to the cantilever effect, the tabletop may not be perfectly level and the self-leveling means may be employed.

The present invention also comprises control means for disabling certain functions when the table is in either the surgical or X-Y mode. Such control means is effective, when the table is in the surgical mode, to energize the X-Y translation locks to prevent the translation of the tabletop. When the table is in the X-Y mode, the control means functions to lock the table to the floor pivot and to release the X and Y locks and to disable the surgical functions.

Accordingly, the present table provides solutions to the aforementioned shortcomings of prior medical tables. This invention provides a table which allows medical personnel to accurately horizontally manually position a patient relative to an imaging apparatus and to immediately enter the surgical mode if surgery is required without requiring the dangerous and time consuming relocation of the patient to a remote surgical suite. For example, diagnostic angiography may be performed on the table and the medical personnel may proceed directly to cardiovascular surgery without requiring any relocation of the patient. Also, this invention allows positioning of a patient for surgery to, for example, expose a tumor and apply radiation directly to the affected area to thereby limit total patient exposure to radiation.

These and other details, objects and advantages of the invention will become apparent as the following description of the present preferred embodiment thereof proceeds.

BRIEF DESCRIPTION OF THE DRAWINGS

In the accompanying drawings, the present preferred embodiment of the invention is shown wherein:

FIG. 15 is a plan view of the longitudinal translation lock of the present invention;

FIG. 16 is a plan view of the longitudinal translation lock assembly;

FIG. 17 is an end view of the longitudinal translation lock assembly;

DETAILED DESCRIPTION OF THE PREFERRED EMBODIMENT

Figure 1:
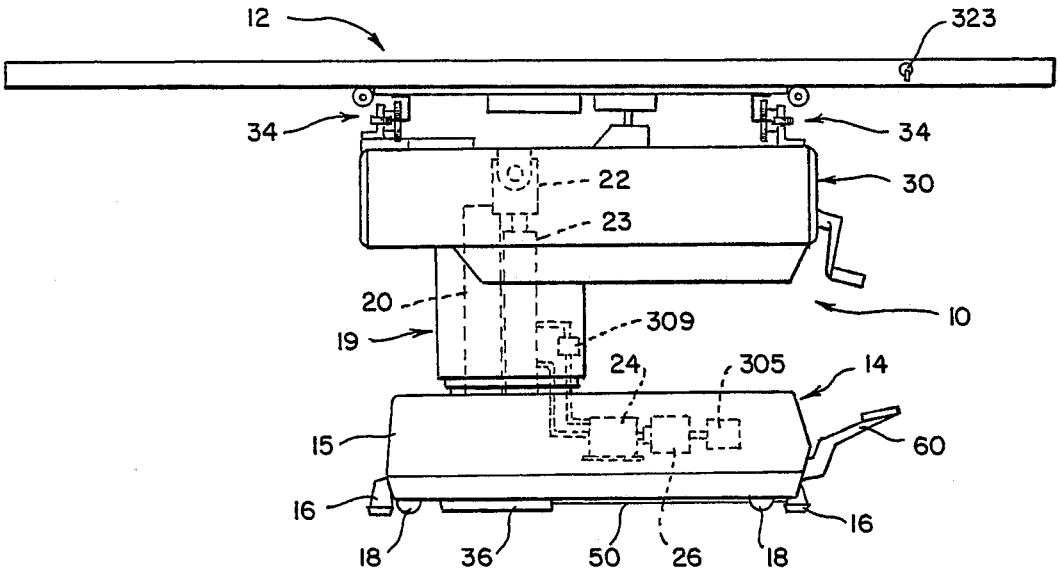
FIG. 1 is a left side elevation view of the surgical table provided herein.

Referring now to the drawings wherein the showing are for purposes of illustrating the present preferred embodiment of the invention only and not for purposes of limiting the same, the Figures show a surgical table 10 which is provided with a movable top assembly 12.

Tabletop Support Assembly

More particularly, and with reference to FIG. 1, there is shown a surgical table 10 having a base member 14 which may either be supported on lowerable feet 16 or on wheels 18 so as to allow the table to be portable. Base member 14 is shielded by a surrounding shroud 15 to prevent contamination thereof. An upwardly extending pedestal assembly 19 is secured to the base 14 and provides a guide column for a yoke 22 which may be raised and lowered adjacent to the column by means of a hydraulic cylinder 23. Fluid pressure for the hydraulic cylinder 23 is provided by a hydraulic pump 24 which is powered by an electric motor 26 controlled by a motor start solenoid 305. Accordingly, when motor 26 is energized, it provides power for pump 24 which, in turn, provides pressurized fluid to hydraulic cylinder 23 to raise yoke 22 which rides along column 20. The lowering of yoke 22 by hydraulic cylinder 23 is controlled by a lower solenoid 309.

Figure 3:
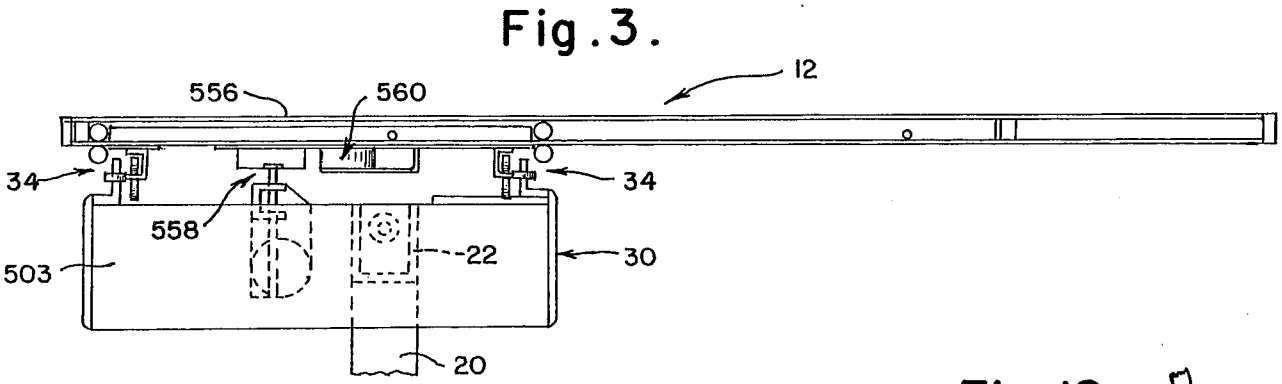
FIG. 3 is a right side elevational view of the surgical table provided herein with the tabletop translated in the longitudinal direction.
Figure 2:
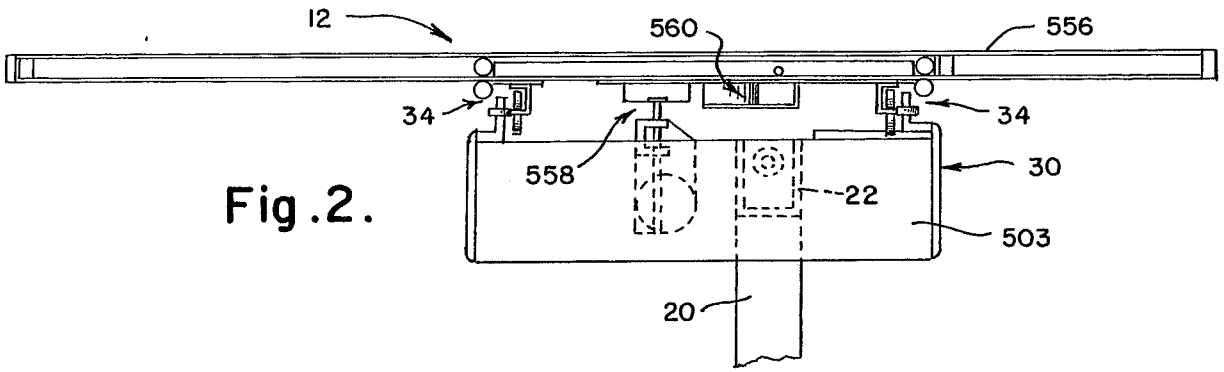
FIG. 2 is a right side elevation view of a portion of the surgical table provided herein.

Yoke 22 is secured to the table superstructure, generally designated as 30. Superstructure 30 includes a surrounding frame 32. Frame 32, in turn, supports a horizontal displacement carriage assembly, generally designated as 34, which is affixed to the underside of top assembly 12. As is described in detail hereinbelow, carriage assembly 34 permits the top assembly 12 to be moved in a horizontal plane both laterally of its longitudinal axis (X direction) and along its longitudinal axis (Y direction). FIG. 2 is representative of the top assembly in a position in which no displacement along the longitudinal axis has taken place, while FIG. 3 is illustrative of the top assembly 12 having been displaced along its longitudinal axis. The "home position" of top assembly 12 is that position thereof from which lateral and longitudinal translation may be initiated.

Floor Bracket Locking Means

Figure 4:
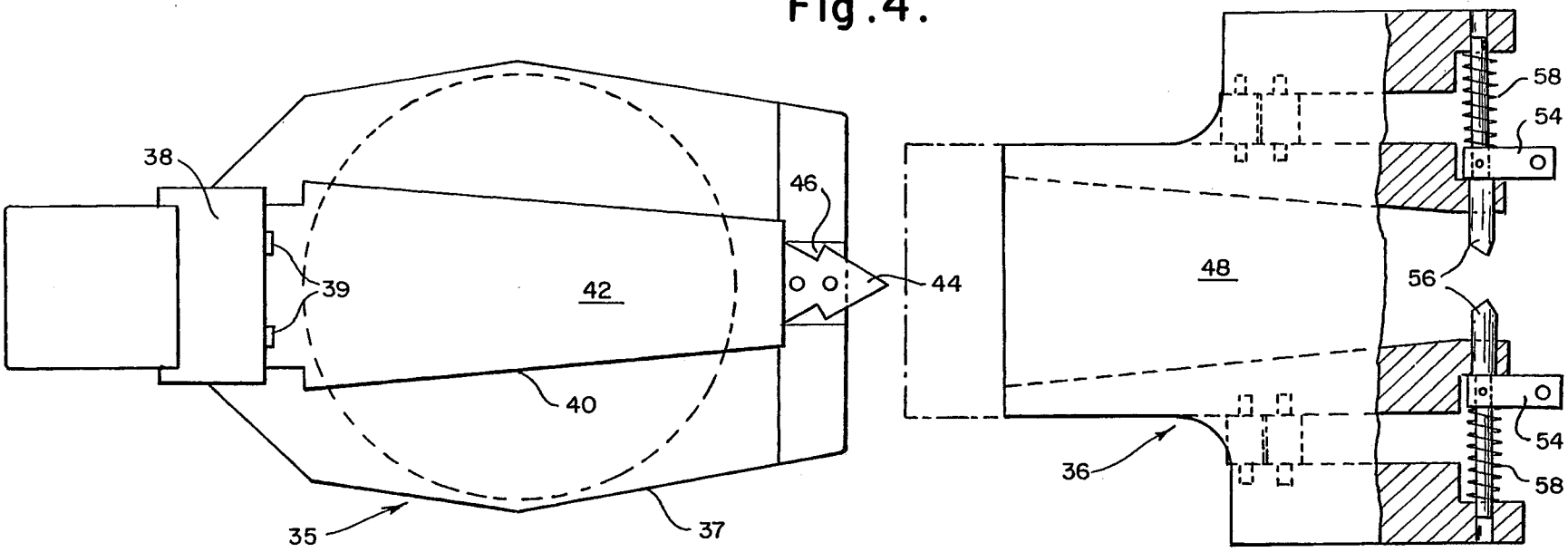
FIG. 4 is a plan view representation of the floor bracket and table connecting means.
Figure 5:
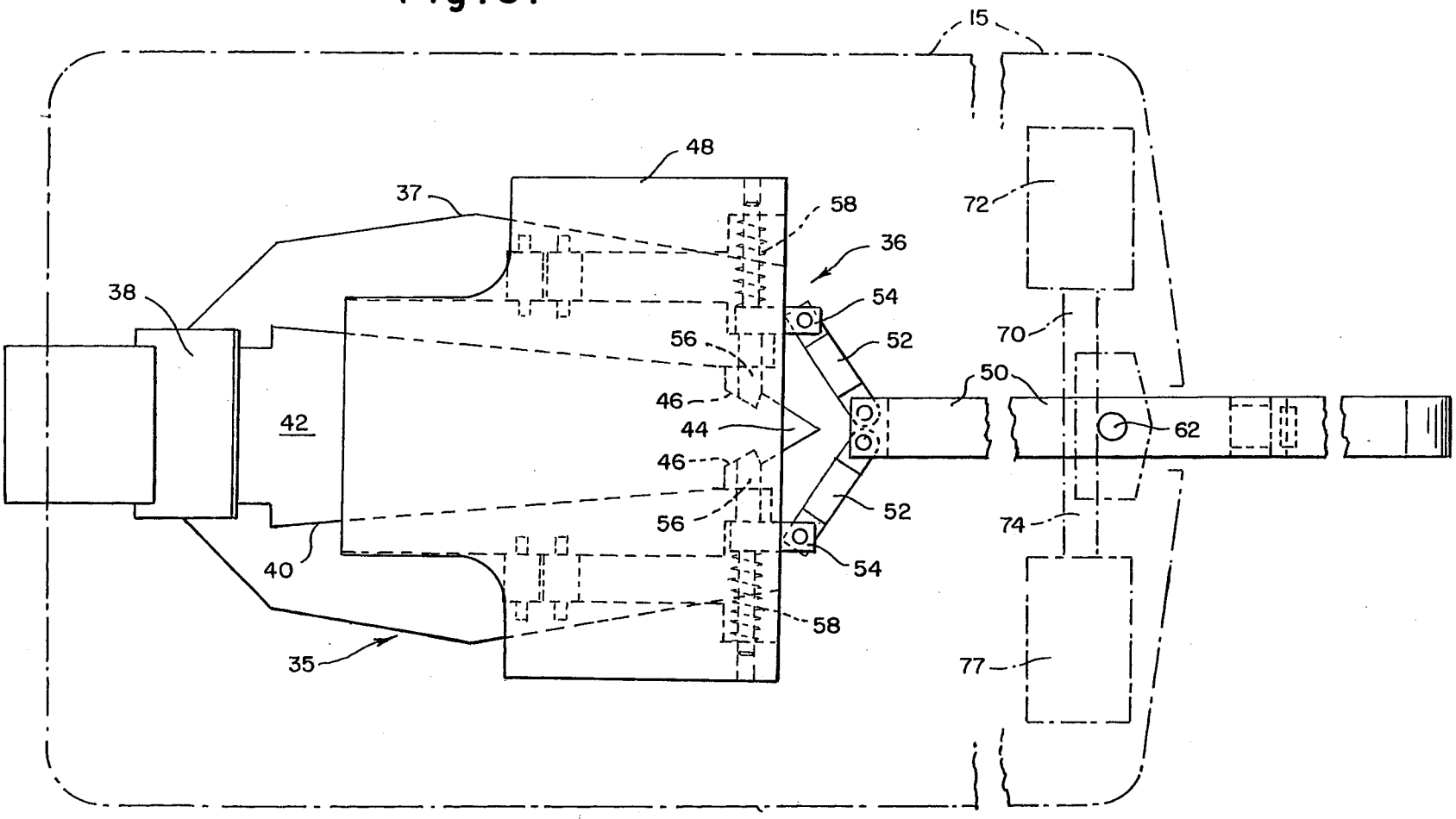
FIG. 5 is an underside plan view of the floor bracket and table connecting means.
Figure 6:
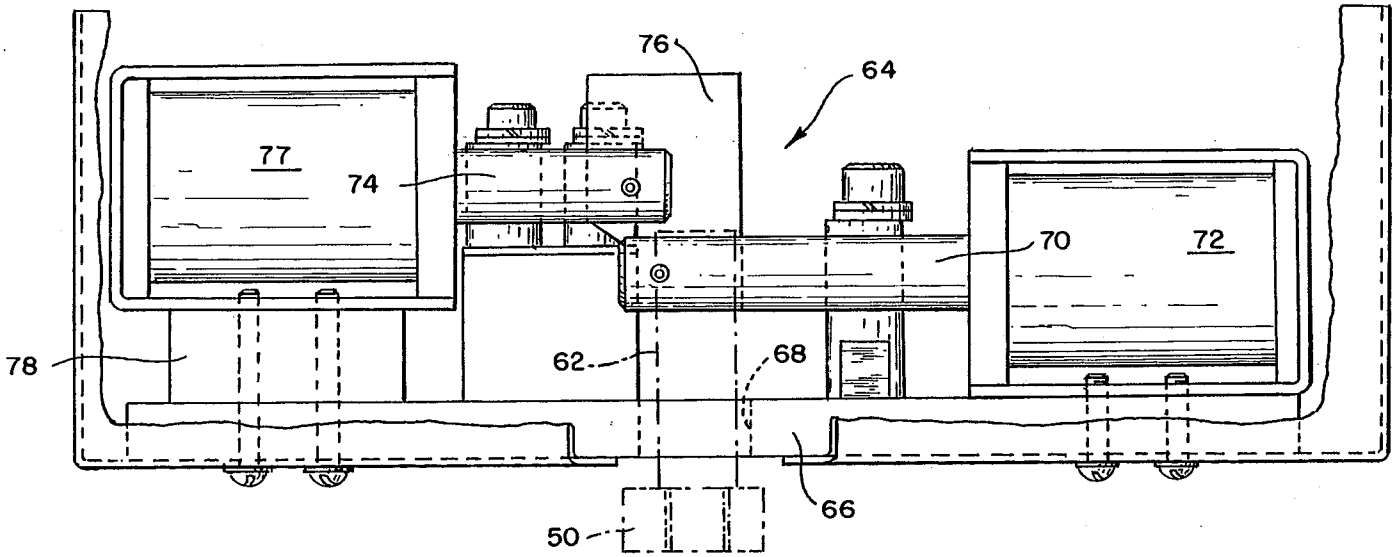
FIG. 6 is an elevation view of the floor bracket locking means.
Figure 7:
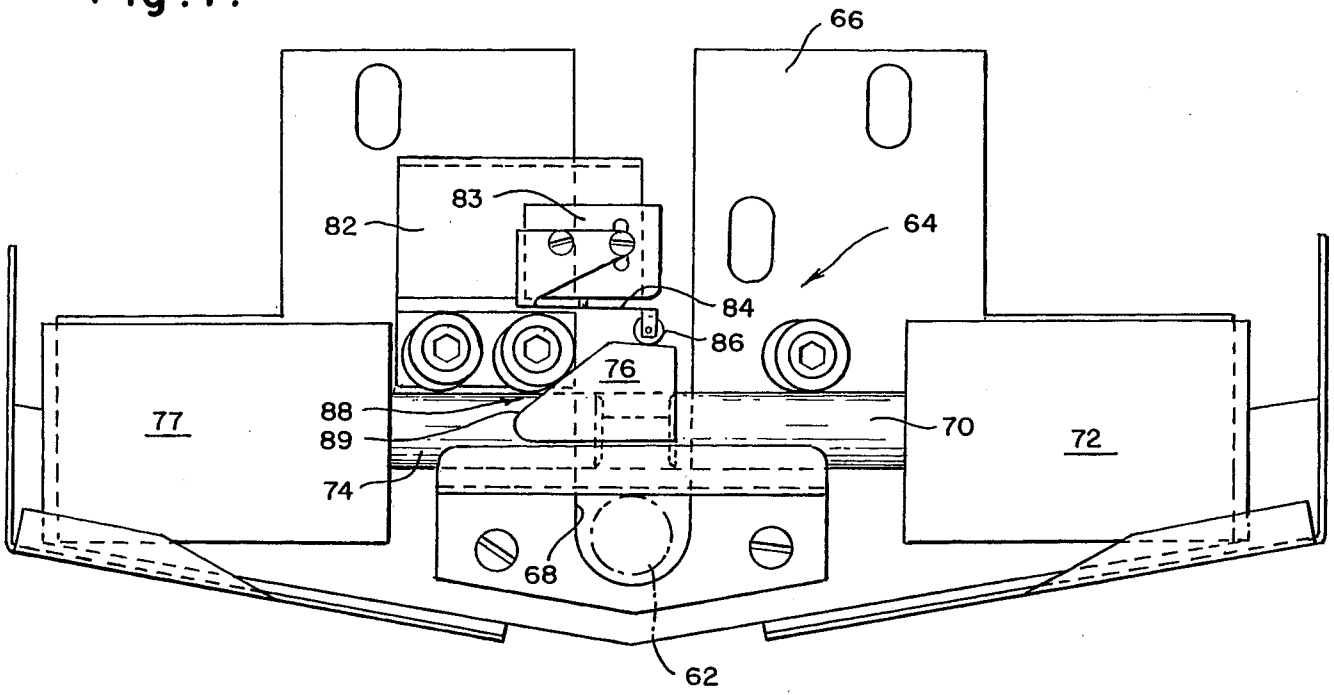
FIG. 7 is a plan view of the floor bracket locking means.
Figure 8:
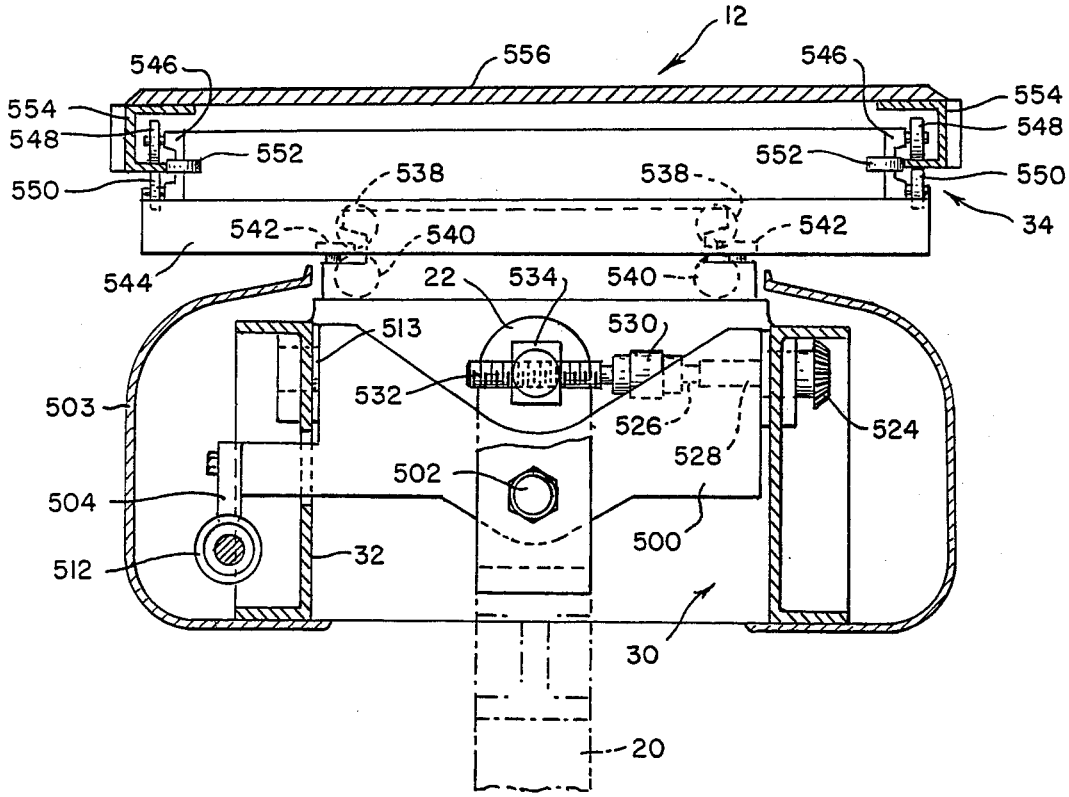
FIG. 8 is an end sectional view of the table superstructure and carriage assembly.
Figure 12:
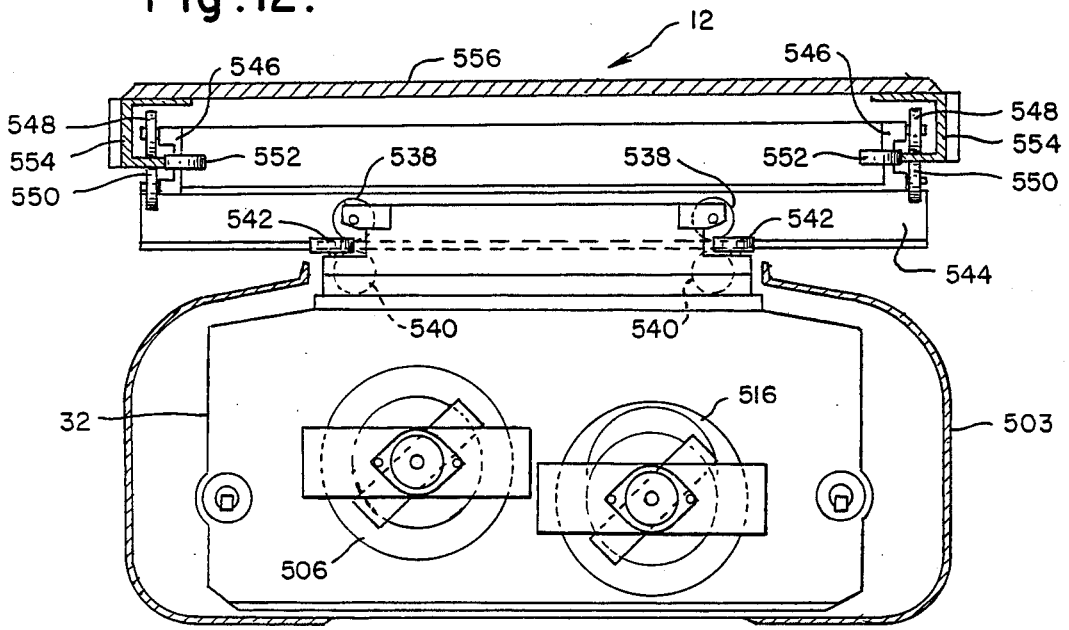
FIG. 12 is an end view of the table superstructure and carriage assembly.
Figure 9:
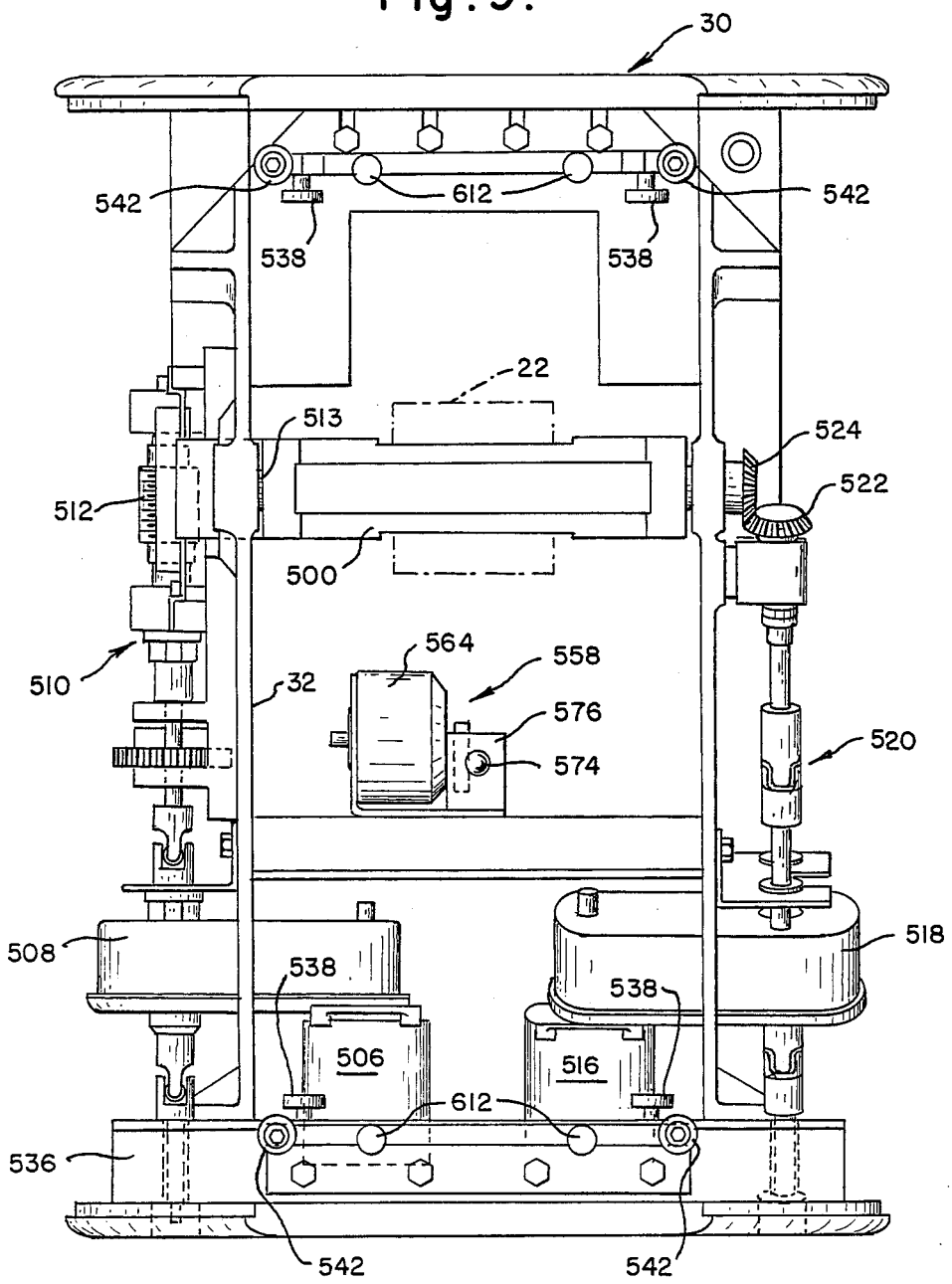
FIG. 9 is a top plan view of the table superstructure assembly.
Figure 10:
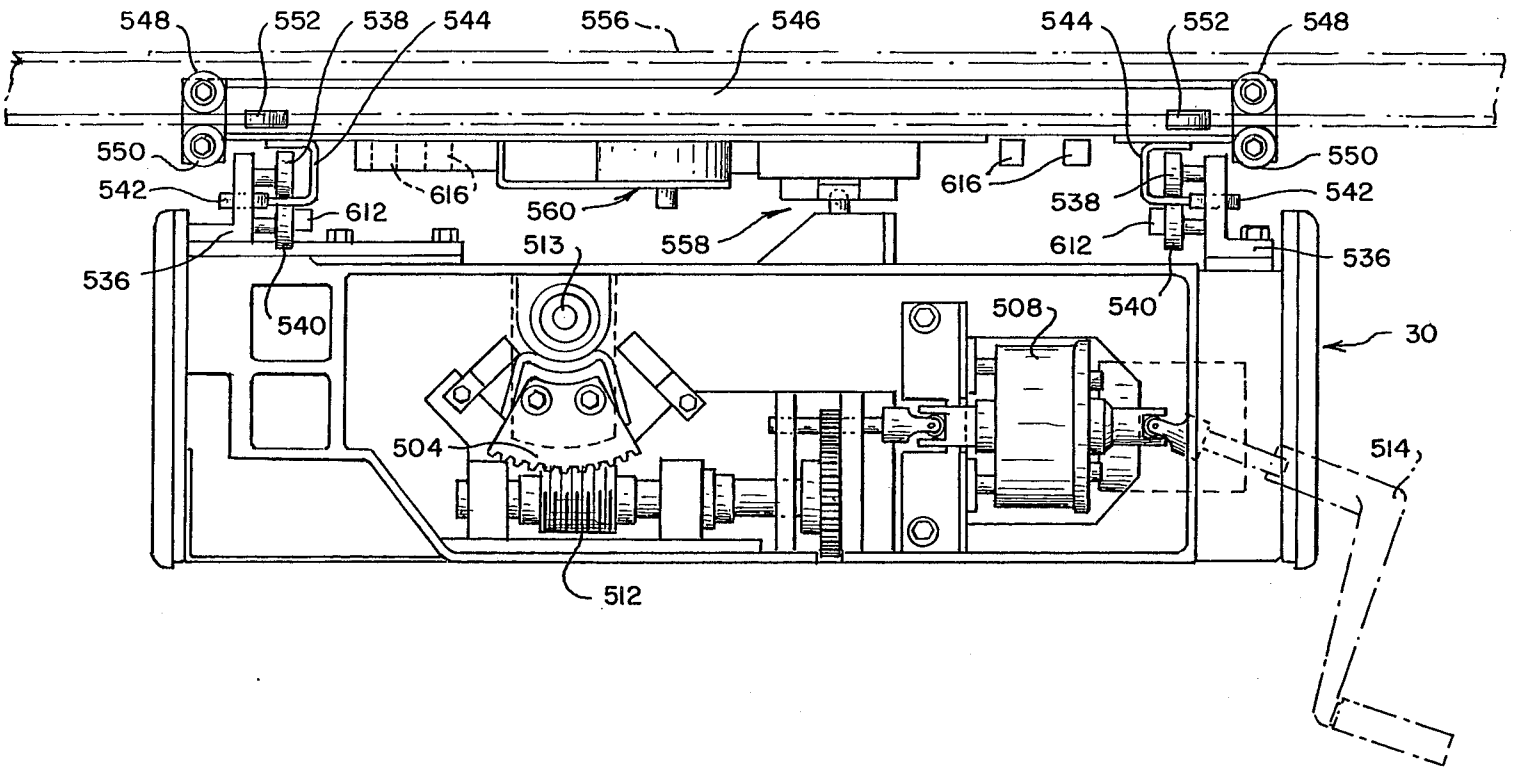
FIG. 10 is a left elevational view of the superstructure and carriage assembly of the instant invention.
Figure 11:
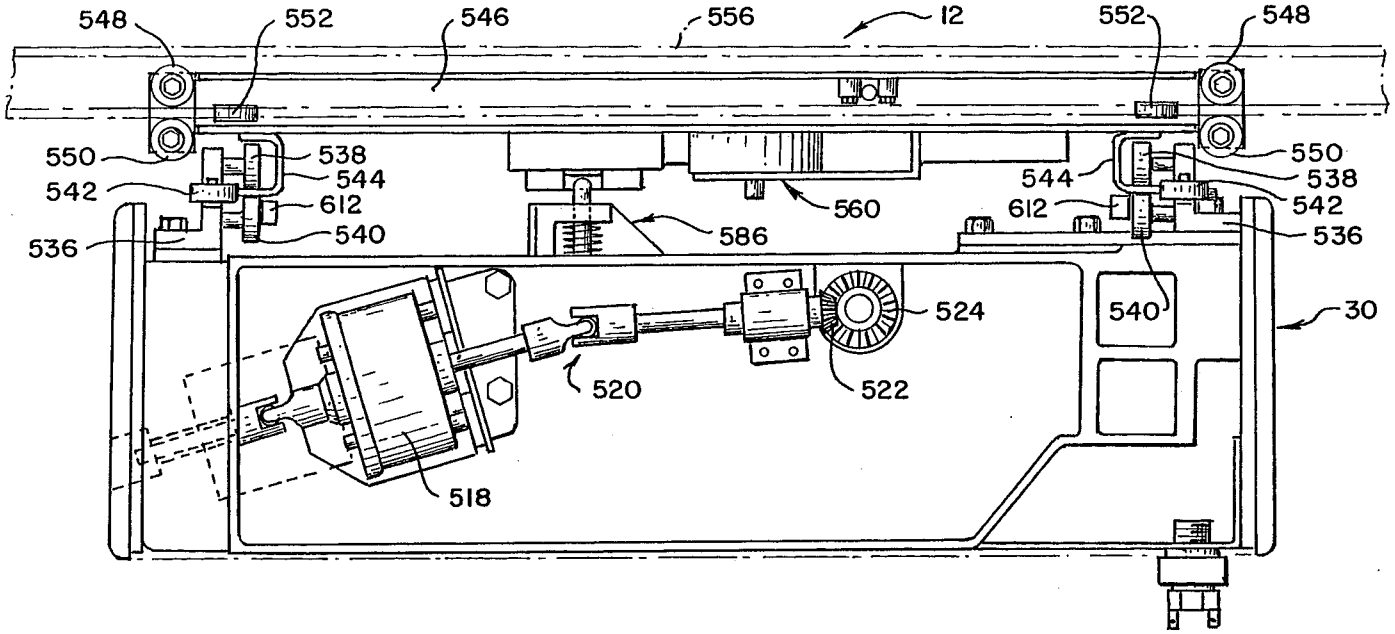
FIG. 11 is a right side elevation view of the table superstructure and carriage assembly of the present invention.
Figure 13:
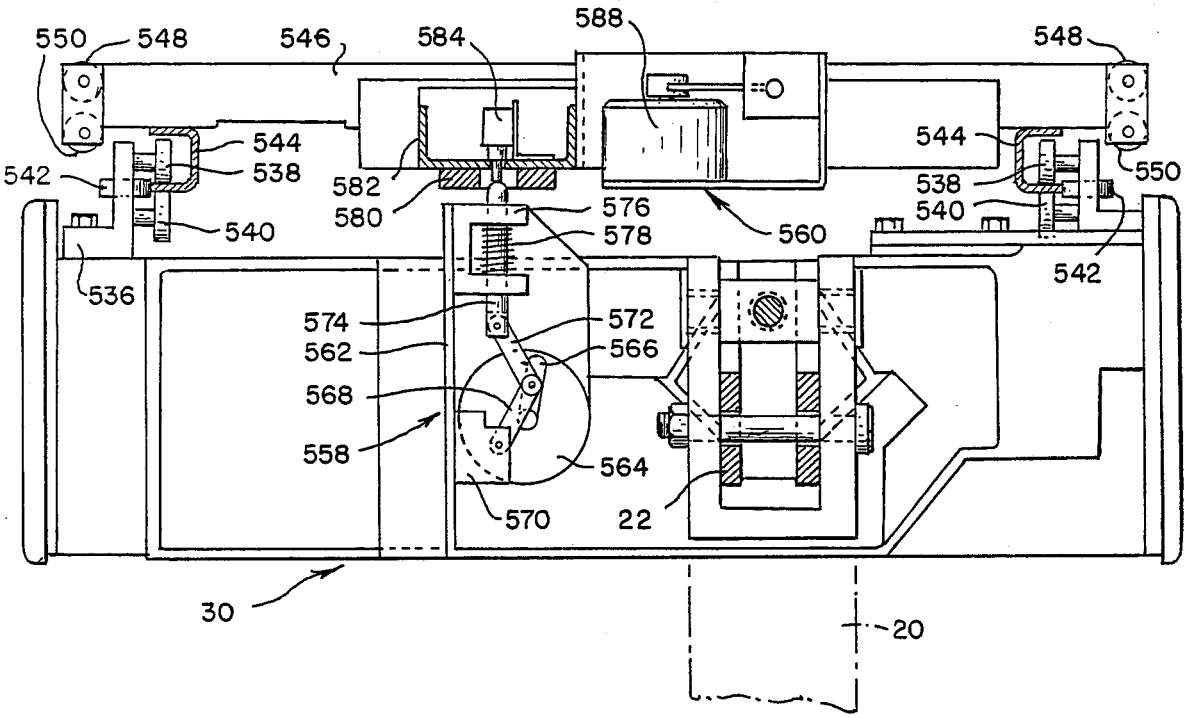
FIG. 13 is a sectional view of the table superstructure and carriage assembly.
Figure 14:
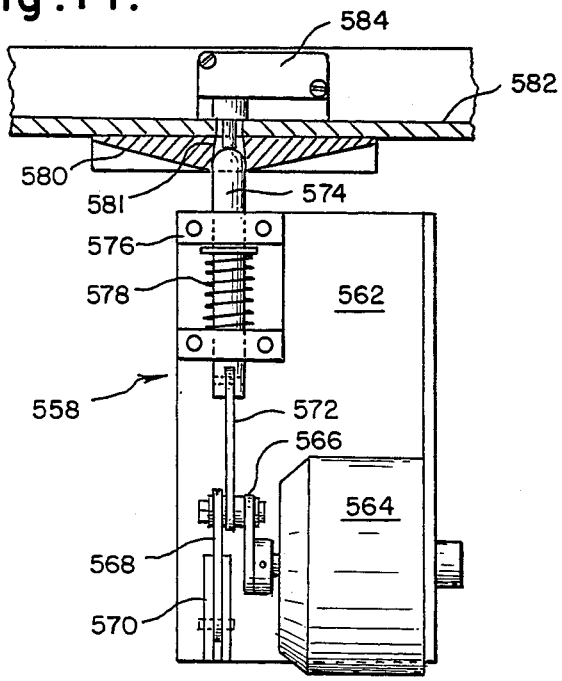
FIG. 14 is a side elevation view of the lateral translation lock assembly according to the invention.

In order to furnish electrical power to the table 10 and to provide stability thereto during horizontal movement of the top assembly1 2, the table 10 is locked to the floor of the operating suite by means of a floor mounted pivot bracket 35 shown in FIG. 4. Floor bracket connecting mechanism, generally 36 is provided on base 14 to connect table 10 to floor bracket 35.

Floor bracket 35 typically includes a base plate 37 which supports an electrical box 38 having electrical contacts 39 extending therefrom. The flange-like edges 40 of an upper plate 42 may be engaged by corresponding structure in the table's connecting mechanism 36 to connect the table 10 the floor bracket 35. Also, the extended tongue 44 of floor bracket 35 is engaged by connecting mechanism 36. Tongue 44 is provided with a notched area 46 which may be engaged by the table's connecting means 36.

Connecting means 36 includes a frame 48 attached to table base 14. A slideable bar 50 is movably supported by table connecting means 36 and has one end thereof pivotally connected to laterally extending links 52. Links 52 are pivotally connected by means of arms 54 to pins 56 which engage the notches 46 on either side of tongue 44 when the connecting means 36 is in engagement with floor bracket 35. The free ends of pins 56 are normally biased by springs 58 into engagement with the notches 46 of tongue 44. As such, when the connecting means 36 is engaged with floor bracket 35, pins 56 serve to lock the table 10 to tongue 44. A foot pedal 60 is pivotally connected to the opposite end of bar 50 such that the depressing of foot pedal 60 causes bar 50 to be displaced toward tongue 48 thereby causing links 52 to draw pins 58 from engagement with the notches 46 while simultaneously causing the end of bar 50 to which the links 56 are connected to contact and push against the tip of tongue 44 to cause the connecting means 36 and, hence, the table 10, to be displaced away from the floor bracket 12.

The engagement of table 10 with floor bracket 36 allows the floor bracket electrical contacts 39 to be engaged by corresponding contacts (not shown) in the base 14 of table 10. Additionally, the engagement of table 10 with floor bracket 35 causes the table 10 to be fixed to the floor in order to stabilize the table 10 in the event the top 12 is displaced from its balanced home position. It will be readily appreciated that if a patient was placed on table 10 and the table was not secured to the floor, if the top assembly 12 was displaced, the table 10 carrying the surgical patient may be capable of overturning.

In order to prevent the undesired movement of bar 50 which causes the release of connecting means 36 from tongue 44, a vertical pin 62 is provided on bar 50 in proximately to foot pedal 60 and it is the preventing of movement of the bar 50 by the retention of pin 62 which causes the connecting means 36 to be secured to the tongue 44. A blocking mechanism 64 includes a base plate 66 which is affixed to the base 14 of table 10 and which is provided with a closed-ended slot 68. When foot pedal 60 is actuated, pin 62 is allowed to move within slot 68 to cause the movement of bar 50 and the release of pins 56 from tongue 44.

In order to prevent the movement of pin 62 and, hence, prohibit the movement of bar 50 to disengage pins 56 from the notches 46 in tongue 44 and thereby release connecting means 36 from floor bracket 35, a blocking plunger 70 is provided. Blocking plunger 70 comprises the plunger of a first pulling electric solenoid 72, also called a pivot unlock solenoid, mounted on plate 66. Blocking plunger 70 is provided to extend laterally across slot 68 at an elevation beneath the top end of pin 62 such that the extension of plunger 70 blocks the movement of pin 62 in slot 68. Blocking plunger 70 is moved into its blocking position by means of an extension plunger 74 which is connected to it by means of a connecting block 76 which is affixed to blocking plunger 70 and extending plunger 74. Extension plunger 74 is mounted horizontally parallel to blocking plunger 70 and in vertically spaced relation thereto such that extension plunger 74 moves in a plane above the upper end of pin 62. Extension plunger 74 comprises the plunger of a second pulling electric solenoid 77, also called a pivot lock solenoid, which is mounted in an elevated position on base plate 66 on a spacer block 78. As such, when second solenoid 77 is energized, extension plunger 74 is retracted thereby drawing by means of connecting block 76 blocking plunger 70 into its extended position blocking the movement of pin 62 along slot 68. When the first solenoids 72 is activated, blocking plunger 70 is retracted thereby extending extension plunger 74 and withdrawing blocking plunger 70 from proximity with pin 62. The activation of second solenoid 77 is caused by the actuation of a control means, described below, which locks the table 10 to the bracket 35. First solenoid 72 is controlled by the control means, described below, which is effective to cause first solenoid 72 to release table 10 from bracket 35 either automatically when top assembly 12 has been moved and returned to its home balanced position relative to column 20 or manually if the table 10 was locked to the floor bracket 35 but top assembly 12 was not displaced.

A support block 82 is also mounted on the base plate 66 adjacent to second solenoid 77 and supports a microswitch 83 from which extends a flexible arm 84 to which there is mounted a cam follower 86. The side of connecting block 76 remote from the closed end of slot 68 is formed as a cam surface 88 which may engage cam follower 86. As such, when extension plunger 74 is retracted thereby extending blocking plunger 70 into blocking relation with slot 68, a first inclined portion 89 of cam surface 88 is moved into engagement with cam follower 86 thereby causing the displacement of arm 84 and the actuation of microswitch 83. When the microswitch 83 is actuated, it generates a signal which indicates that the blocking plunger 70 is in its slot 68 blocking position thereby indicating that the connecting means 36 is locked to tongue 44 and release therefrom is prohibited. Upon the generation of such signal by microswitch 83, the circuitry which enables the displacement of tabletop 12 is activated. Accordingly, top 12 may only be displaced when blocking plunger 70 is extended to block the movement of pin 62 along slot 68.

Table Superstructure

As indicated above, the table superstructure 30 includes a surrounding horizontal frame 32. Frame 32 is supported on yoke 22 by means of a saddle 500. Saddle 500 is connected to yoke 22 by means of pin 502. Accordingly, saddle 500 may be raised and lowered along with yoke 22 by means of hydraulic cylinder 23 and is pivotable about pin 502 on yoke 22. A surrounding shell 502 is provided about table superstructure 30 so as to conceal the moving parts thereof and to prevent such from contamination.

In order to achieve the longitudinal tilting of top assembly 12 relative to base 14, saddle 500 is provided with a sector gear 504 which extends through frame 32 and beyond one side thereof. A longitudinal tilt or Trendelenburg function controlling electric motor 506 is mounted on frame 32 and is provided with a gear reduction unit 508. Gear reduction unit 508 powers by means of a drive train, generally designated as 510, a worm gear 512. Accordingly, as the worm gear 512 is rotated relative to sector gear 504 and sector gear 504 is fixed relative to frame 32, the relative movement of worm gear 512 on sector gear 504 causes the frame 32 to be pivoted about pins 513 so as to enable the frame 32 and, hence, the tabletop 12 to be tilted in the Trendelenburg and Reverse Trendelenburg directions. In the event of a power outage, a handle 514 may be connected to gear reduction unit 508 to provide the manual operation of Trendelenburg and Reverse Trendelenburg tilting.

An electric tilt motor 516 is also mounted on frame 32. Tilting motor 516 is connected by means of a gear reduction unit 518 to a drive train generally designated as 520. Drive train 520 causes the rotary movement of a first miter gear 522. Miter gear 522 imparts rotary motion to a second miter gear 524. Second miter gear 524 is coaxial with and provides rotary movement to a drive shaft 526 which is connected to saddle 500 by means of a journal 528. A universal joint 530 couples shaft 526 to a acme screw 532. A threaded coupling 534 is pivotally supported between apertures in yoke 22 and has acme screw 532 threaded thereinto. Accordingly, acme screw 532 is able to be displaced relative to threaded coupling 534. As such, the activation of tilt motor 516 causes the gear reduction unit 518 to provide a rotational output to drive train 520 which, in turn, rotates first miter gear 522 and second miter gear 524. The rotation of miter gear 524 then rotates shaft 526 and universal joint 530 so as to cause acme screw 532 to be displaced relative to threaded coupling 534. Due to the fact that drive shaft 526 is journaled by means of journal 528 to frame 32, the movement of acme screw 532 relative to threaded coupling 524 causes the effective distance between threaded coupling 534 and journal 528 to be altered, thereby either attempting to move the side of frame 32 on which journal 528 is provided closer to or further away from yoke 22. It is this effective altering of the distance between yoke 22 and frame 32 which causes the side to side tilting of frame 32 and, hence, the lateral movement of tabletop 12 about its longitudinal axis.

Horizontal carriage assembly 34 includes front and rear brackets 536 which are secured to the upper surfaces of the transverse members of frame 32. Each of the brackets 536 include two sets each of upper rollers 538 and lower rollers 540 as well as first lateral rollers 542. Supported between upper rollers 538, lower rollers 540 and first lateral rollers 542 are lateral channels 544. Accordingly, it is the movement of lateral channels 544 on upper rollers 538, lower rollers 540 and first lateral rollers 542 which causes top assembly 12 to be moved laterally relative to table superstructure 32. Secured to the upper surfaces of lateral channels 544 are longitudinal C-shaped channels 546. Each of the longitudinal channels 546 supports at fore and aft locations an upper roller 548, a lower roller 550 and a lateral roller 552. Supported between upper roller 548, lower roller 550 and lateral roller 552 are upper longitudinal C-shaped channels 554 which face inwardly relative to the carriage assembly 34. A radioluscent table surface 556 which allows radiation to pass therethrough unaffected is secured to the upper surfaces of upper longitudinal channels 554. Accordingly, the displacement of upper longitudinal channels 554 along upper roller 548, lower roller 550 and lateral roller 552 permit the longitudinal displacement of table surface 556 relative to the table superstructure 30.

Translation Lock Assemblies

Applicants have realized that in order to provide a table 10 in which the top assembly 12 may be both operated in a surgical mode and in an X-Y mode, it is necessary that the carriage assembly 34 be prevented from movement when the top assembly 12 is in the surgical mode. As such, the present invention is provided with an X translation lock assembly, generally indicated as 558, for preventing lateral horizontal displacement of the table and a longitudinal or Y translation lock assembly, generally designated 560, for preventing longitudinal displacement of the tabletop 12 when the table is in the surgical mode.

The X translation lock assembly 558 includes a bracket 562 which is affixed to the frame 32 of superstructure 34. Bracket 562 supports a first rotary electric solenoid 564 which is capable of providing a rotational output. The rotation output of first rotary solenoid 564, also called the X unlock solenoid, is connected to a first link 566. First link 566 is pivotally connected to a second link 568 which is pivoted at its other end to a block 570 attached to bracket 562. First link 566 and second link 568 are both pivotally connected to a transmitting link 572 which is pivotally attached to the lowermost portion of a vertical locking shaft 574. Locking shaft 574 is supported by means of a trunnion 576 secured to bracket 562. A return spring 578 is provided on trunnion 576 to normally urge locking shaft 574 to an extended position. It is the action of first electric solenoid 564 in cooperation with first link 566, second link 568 and transmitting link 572 which causes locking shaft 574 to be retracted downwardly.

Locking shaft 574 is intended to cooperate with a receptacle plate 580 having a receptacle area 581 and which is mounted on a bracket 582 supported on the underside of longitudinal channels 546. A limit switch 584 is also mounted on bracket 582 to sense and generate a signal when locking shaft 574 is in position within the recessed area of receptacle plate 580. Accordingly, when locking shaft 574 is extended by first rotary solenoid 564 into the recessed area 581 of receptacle plate 580, the signal from limit switch 584 in cooperation with the logic circuitry described below causes the carriage assembly 34 to be prohibited from displacement in a direction lateral to the longitudinal axis of table assembly 12. Due to the action of spring 578, when solenoid 564 is not activated and the carriage assembly 34 is moved laterally over locking shaft 524, locking shaft 574 will enter recessed area 581 to lock its position.

The Y translation lock assembly 560 is mounted on a bracket 586 mounted between transverse bracket 582 and one of the longitudinal channels 546. A second rotary electric solenoid 588, also called the Y unlock solenoid, is mounted on bracket 586 so as to impart a rotary motion to a third link 590. Third link 590 is pivotally attached to an intermediate link 591 which is also attached to a fourth link 592. Fourth link 592 is also pivotally attached to a block 594 which is mounted on bracket 586. Intermediate link 591 and fourth link 592 are also pivotally attached to a second transmitting link 598 which is pivotally attached to the inboard end of a horizontal locking shaft 600. Locking shaft 600 is supported for horizontal displacement by means of a trunnion 602 mounted on bracket 586. A spring 603 is provided on trunnion 602 and about locking shaft 600 so as to normally urge locking shaft 600 to an extended position. A limit switch 603 is mounted on trunnion 602 and includes an arm which may be engaged by a lug 606 on locking shaft 600 to indicate whether locking shaft 600 is in its extended or retracted position. Locking shaft 600 extends through one of the longitudinal channels 546 and includes on its outboard end a roller 608. Roller 608 may engage a notched area 610 in upper longitudinal channels 554 so that when locking shaft 600 is not retracted by solenoid 588 is it extended so that it may ride along upper longitudinal channel 554 until the roller 608 meets notch 610 and enters that area so as to lock upper longitudinal channel 554 to longitudinal channel 546 and, hence, prevent the longitudinal displacement of carriage assembly 34.

In the operation of table 10, it is also desired that the carriage assembly 34 be selectively prevented from movement in the X-Y mode. Due to the retraction of X and Y locking shafts 574 and 600, respectively, alternate securing means are provided. These means includes solenoid operated magnetic brakes. In particular, dual sets of magnetic brakes 612 are mounted on brackets 536 to engage the lateral channels 544 so as to prevent their movements. Solenoids 614, also called magnetic brack lock solenoids, control the actuation of magnetic brakes 612 as described hereinbelow. In addition, dual sets of magnetic brakes 616 are provided on the underside of longitudinal channels 546 to engage upper longitudinal channels 554 so as to prevent their movement. The magnetic brakes 616 are controlled by magnetic brake lock solenoids 618 as described below. As such, magnetic brakes 612 and 616 are effective to prvent the movement of carriage asembly when the X and Y translation locks 558 and 560, respectively, are not energized.

Figure 20:
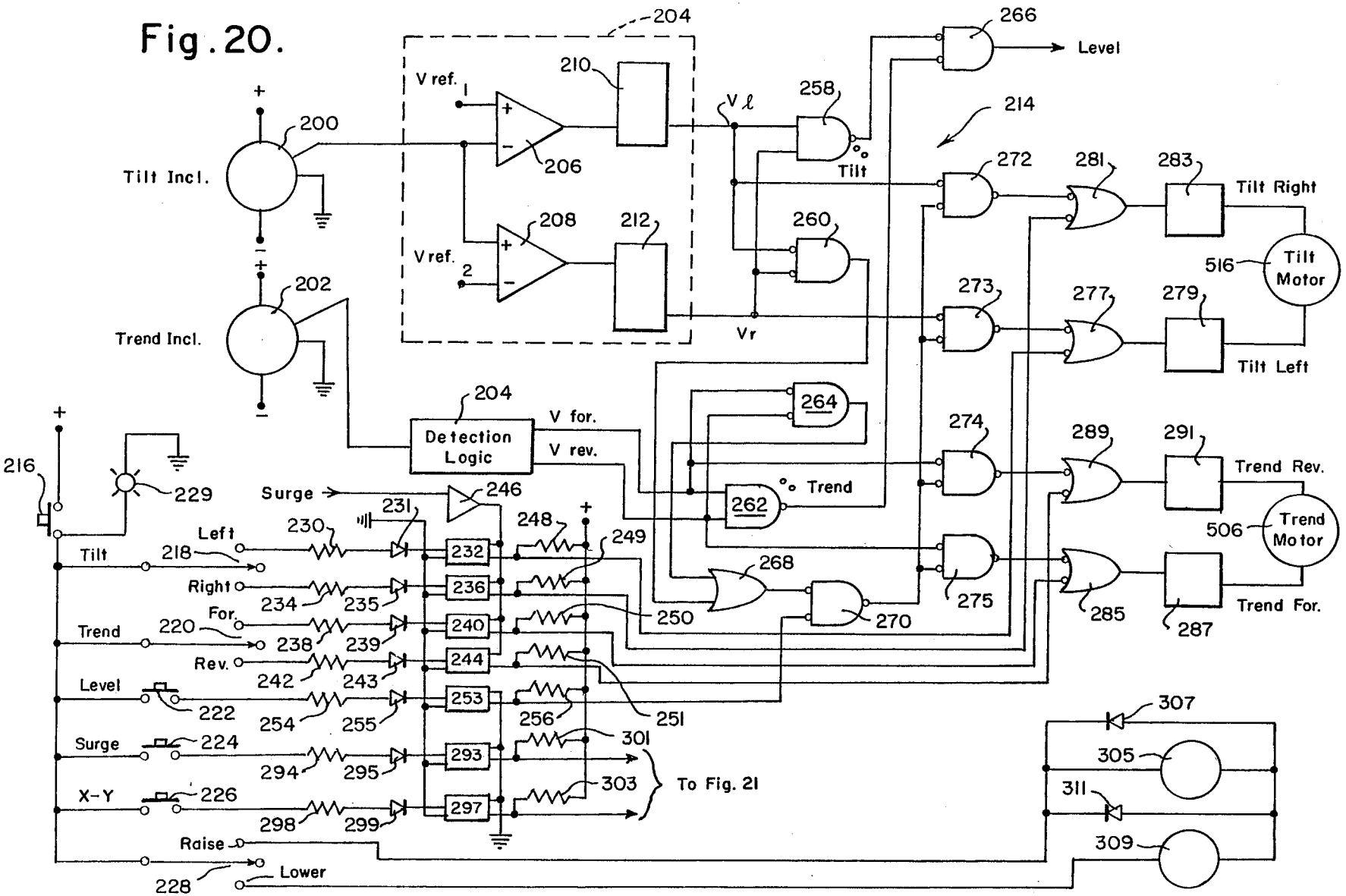
FIG. 20 is an electrical schematic illustrating the self-leveling control means and switches on the control box of the present invention.

Detailed Description Of Self-Leveling Feature And Switches on Hand-Held Remote Control Box The self-leveling feature of the present invention is provided by the circuitry shown in FIG. 20. In the upper left hand corner of the Figure, an inclinometer 200, responsive to the tilt of the top assembly 12, and an inclinometer 202, responsive to Trendelenburg (head up or head down) positions, are illustrated. The inclinometers may be of a type produced by Sperry Corporation such as Model No. 02338-03. The inclinometers may be mounted on any area of the table which executes the tilt and Trendelenburg movements such as on carriage frame 32.

As is known, the aforementioned inclinometers have five leads connected thereto. Two of the leads are connected across a voltage source, two of the leads are grounded, and a third lead is connected to detection logic 204. Since the detection logic 204 is the same for both inclinometers, only the detection logic used in conjunction with the tilt inclinometer 200 is illustrated.

The signal produced by the tilt inclinometer 200 is input to a first comparator 206 and a second comparator 208. The first comparator 206 compares the signal produced by the tilt inclinometer 200 to a first reference signal the $V_{ref1}$ and produces a signal in response to that comparison which is input to a flip-flop 210. The second comparator compares the signal produced by the tilt inclinometer 200 to a second reference signal $V_{ref2}$ and produces a signal in response to that comparison which is input to a flip-flop 212. The flip-flop 210 produces a signal $V_1$ when the top assembly 12 is tilted toward the left and produces a signal $V_r$ when the top assembly 12 is tilted toward the right.

Figure 19:
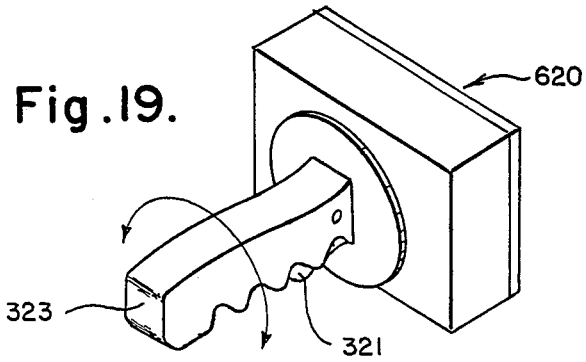
FIG. 19 is an isometric view of the safety handle switch and trigger switch of the invention.

In a similar manner, the Trendelenburg inclinometer 202 operates in conjunction with detection logic 204 to produce a signal $V_{for}$ when the table is in a forward Trendelenburg position and a signal $V_{rev}$ when the table is in a reverse Trendelenburg position. The four signals $V_l$, $V_r$, $V_{for}$, $V_{rev}$ are input to gating logic generally designated in FIG. 19 as 214.

Figure 18:
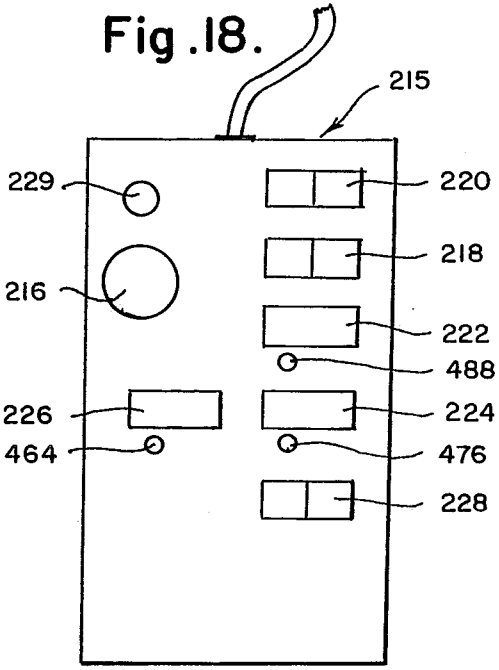
FIG. 18 is a plan view of the remote controller of the present invention.

Before discussing the gating logic 214, the various switches provided on a hand-held remote control box 215 will be discussed. The remote control box 215 is shown in detail in FIG. 18. In the bottom left hand corner of FIG. 20, a power switch 216 is illustrated which, when closed, provides power to a tilt switch 218, a Trendelenburg switch 220, a level switch 222, a surgical mode switch 224, an X-Y mode switch 226, and a raise-lower switch 228. When the power switch 216 is closed, an indicator light 229 provides a power on indication.

The tilt switch 218 and Trendelenburg switch 220 are both rocker type switches. The tilt switch 218 has one position which causes the top assembly 12 to tilt to the left and a second position which causes the top assembly 12 to tilt to the right. Similarly, the Trendelenburg switch 220 has one position which causes the top assembly 12 to move in a forward Trendelenburg position and a second position which causes the table top to move in a reverse Trendelenburg position. Each of these rocker switches has two terminals which are each connected through the series combination of a resister and a diode to a first input terminal of an optical isolator. Thus, a "left" terminal of the tilt switch 218 is connected through a resistor 230 and a diode 231 to a first input terminal of an optical isolator 232. A "right" terminal of the tilt switch 220 is connected through a resister 234 and a diode 235 to a first input terminal of an optical isolator 236. A "forward" terminal of the Trendelenburg switch 220 is connected through the series combination of a resistor 238 and a diode 239 to a first input terminal of an optical ioslator 240. A "reverse" terminal of the Trendelenburg switch 220 is connected through the series combination of a resister 242 and diode 243 to a first input terminal of an optical isolator 244. Each of the optical isolators 232, 236, 240, and 244 has a second input terminal connected to ground.

Each of the optical ioslators 232, 236, 240, and 244 has a first output terminal responsive to a SURG signal available through an inverter 246. Each of the optical ioslators 232, 236, 240, and 244 has a second output terminal connected to a positive voltage source through a resistor 248, 249, 250, and 251, respectively. A signal is available at the second output terminal of the optical isolator 232 which causes the assembly 12 top to tilt toward the left. A signal is available at the second output terminal of the opical isolator 236 which causes the top assembly 12 to tilt toward the right. A signal is available at the second output terminal of the optical isolator 240 which causes the top assembly 12 to assume a forward Trendelenburg position. A signal is available at the second output terminal of the optical isolator 244 which causes the top assembly 12 to assume a reverse Trendelenburg position. These four signals are input to the motors through the gating logic 214 as described hereinbelow. It should be noted, however, that the tilt switch 218 and Trendelenburg switch 220 are operable only when the table is in the surgical mode, i.e. the SURG signal is available.

The signal available at the second output terminal of the optical isolator 232 (which causes the top assembly 12 to tilt toward the left) is input to the tilt motor 516 through a tilt left motor drive circuit 279 and a logic gate 277. The signal available at the second output terminal of the optical isolator 236 (which causes the table top to tilt toward the right) is input to the tilt motor 516 through a tilt right motor drive circuit 283 and a logic gate 281. In this manner, when the rocker switch 218 is depressed so that the left contact of the switch is energized, a signal is conducted through the logic gate 277 to circuit 279 which causes the top assembly 12 to tilt to the left. Conversely, whenever the right contact of the tilt switch 218 is energized, a signal is available which is conducted through gate 281 to circuit 283 which causes the top assembly 12 to tilt toward the right.

In a similar fashion, a signal is produced by activating the forward terminal of the Trendelenburg rocker switch 220 which is input through a logic gate 285 to a forward Trendelenburg motor drive circuit 287 which causes a top assembly 12 to assume a forward Trendelenburg position. Whenever the reverse Trendelenburg terminal of the switch 220 is activated, a signal is produced which is input through a gate 289 to a reverse Trendelenburg motor drive circuit 291 which causes the top assembly 12 to assume a reverse Trendelenburg position.

A level switch 222 is provided. A output terminal of the level switch 222 is connected to a first input terminal of an optical isolator 253 through the series combination of a resister 254 and diode 255. The optical isolator 253 has a second input terminal and a first output terminal which are connected to ground. A second output terminal is connected to a positive voltage source through a resistor 256. A signal is available at the second output terminal of the optical isolator 253 whenever the user depressed the level switch 222 thus indicating that the surgical table is to automatically self level. That signal is input to the gating logic 214.

The signals $V_l$ and $V_r$ are each input to a first logic gate 258 and a second logic gate 260. The first logic gate 258 produces a level signal indicative of the tilt of the top assembly 12.

The signals $V_{for}$ and $V_{rev}$ are each input to a third logic gate 262 and a fourth logic gate 264. The gate 262 produces a signal indicative of the Trendelenburg position of the top assembly 12. The signal produced by the gate 258 and the signal produced by the gate 262 are input to a logic gate 266 which produces a level signal whenever the top assembly 12 is level.

The signal produced by the logic gate 260 and the signal produced by the logic gate 264 are input to a logic gate 268. The signal produced by the gate 268 is input to a first input terminal of a logic gate 270. The logic gate 270 also receives the signal produced by the level switch 222 at a second input terminal thereof. The logic gate 270 produces an enable signal which is available at its output terminal.

The enable signal is input to a first input terminal of each of four logic gates 272, 273, 274, and 275. The logic gate 272 receives the signal $V_l$ at its second input terminal; the logic gate 273 receives the signal $V_r$ at its second input terminal; the logic gate 274 receives the signal $V_{for}$ at its second input terminal; the logic gate 275 receives the logic signal $V_{rev}$ at its second input terminal. Each of the logic gates 272 through 275 selectively conducts the signal at its second input terminal in response to the enable signal produced by the logic gate 270. In this manner, even though the tilt and Trendelenburg inclinometers 200 and 202, together with the associated detection logic 204, are constantly producing signals which are capable of automatically leveling the table, until the level switch 222 is depressed, those signals are not input to the motor drive circuitry.

The signal $V_l$, which indicates that the top assembly 12 is tilted to the left, is conducted by the gate 272 to the logic gate 281 which energizes the tilt right motor drive circuit 283. The tilt right motor drive circuit 283 remains energized until the tilt inclinometer 200 produces a signal which indicates that the top assembly 12 is no longer tilted to the left. In a similar fashion, the signal $V_r$, indicative of the top assembly 12 being tilted to the right, is conducted by logic gate 273 to the logic gate 277 to energize the tilt left motor drive circuit 279; the signal $V_{for}$ is input through the logic gates 274 and 289 to energize the reverse Trendelenburg motor drive circuitry 291; the signal $V_{rev}$ is input through logic gates 275 and 285 to energize the forward Trendelenburg motor drive circuitry 287. In this manner, signals which are produced by the inclinometers 200 and 202 are used to automatically return the top assembly 12 to a level position.

Completing the description of the circuitry shown in FIG. 20, the bottom left hand corner illustrates a surgical mode switch 224 and an X-Y mode switch 226. These switches enable the user to select the mode in which the table will be used. An output terminal of the surgical mode switch 224 is connected to a first input terminal of an optical isolator 293 through the series combination of a resister 294 and a diode 295. A second input terminal of the optical isolator 293 is connected to ground. In a similar manner, an output terminal of the X-Y mode switch 226 is connected to a first input terminal of an optical isolator 297 through the series combination of a resister 298 and a diode 299. A second input terminal of the optical isolator 297 is connected to ground.

Figure 21:
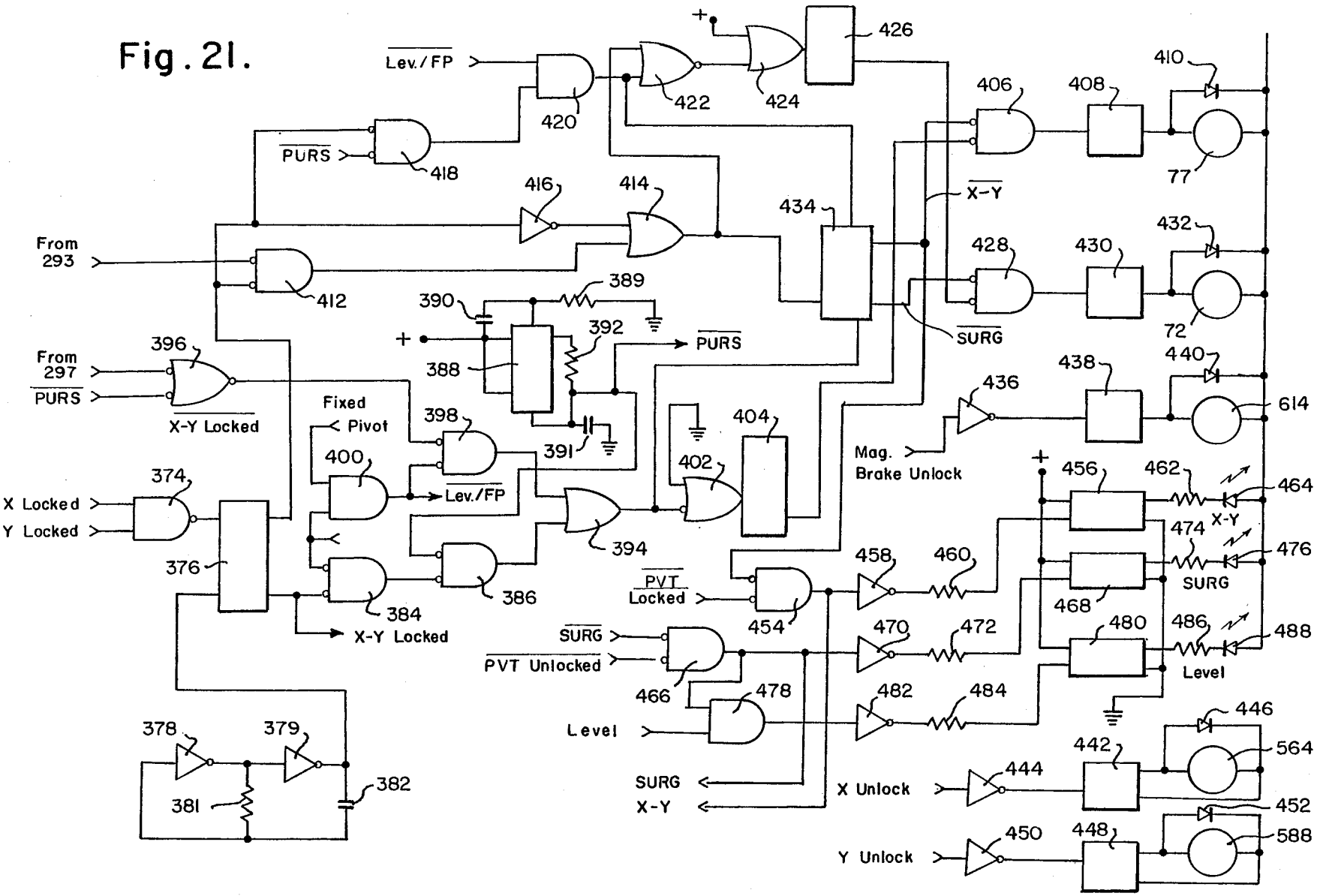
FIG. 21 is an electrical schematic illustrating the circuit for producing the interlock and indicator signals.

The optical isolators 293 and 297 each have a first output terminal connected to ground and a second output terminal connected to a positive voltage source through resistors 301 and 303, respectively. The signals available at the second output terminal of the optical isolators 293 and 297 are used in the logic which is shown in FIG. 21 and discussed hereinbelow.

Finally, the raise-lower switch 228 is a rocker switch having a "raise" terminal and a "lower" terminal. The "raise" terminal of the height switch 228 energizes a conventional pump motor start solenoid 305. A diode 307 is connected across the solenoid 305. With the pump motor 26 energized, hydraulic cylinder 23 may be used to raise the table.

In a similar fashion, the height switch 228 has "lower" terminal which, when energized, causes a pump motor lower solenoid 309 to be energized. A diode 311 is connected across the solenoid 309.

Production Of Interlock And Indicator Signals

Figure 22:
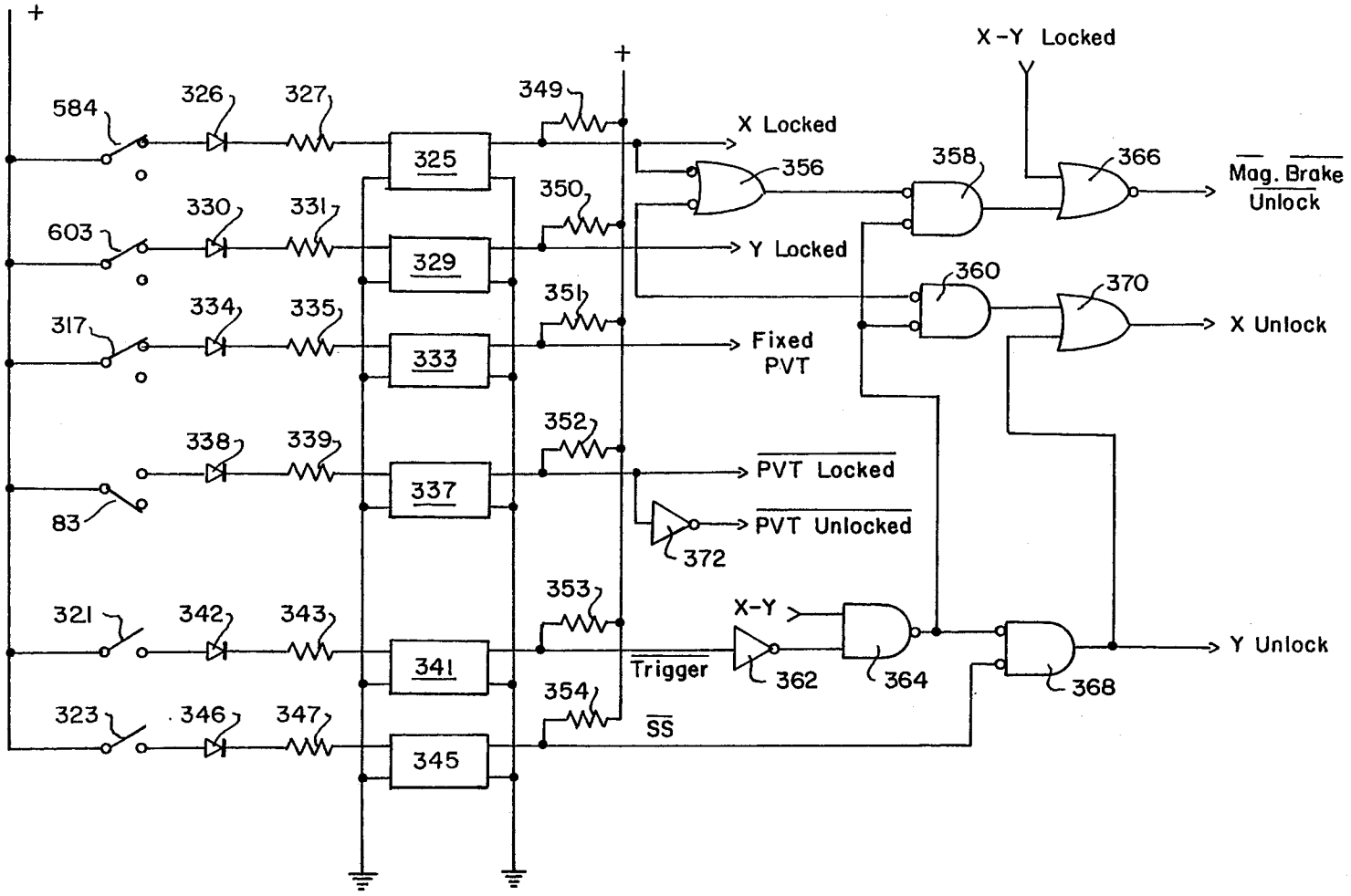
FIG. 22 is an electrical schematic illustrating the circuit for producing signals representative of the status of the top assembly of the present invention.

The circuit of the present invention which produces the various interlock signals is illustrated in FIG. 21. In FIG. 21, a plurality of solenoids may be seen along the right hand side of the figure which provide various functions. The pivot lock solenoid 77, pivot unlock solenoid 72, the magnetic brake lock solenoids 614 and 618 (not shown), the X unlock solenoid 564, and the Y unlock solenoid 588 provide the various functions described above. Limit switch 317 senses if the table's connecting means 38 is connected to the floor pivot 36. Before describing the circuit which produces the signals for operating those solenoids, an understanding of FIG. 22 is helpful.

In FIG. 21, four limit switches 584, 603, 318 and microswitch 83 are shown together with the trigger switch 321 and rotatble handle safety switch 323. The trigger swtich 321 and rotatable handle safety switch 323 are shown in detail in FIG. 19. The limit switches, trigger switch, and safety switch provide information regarding the status of the table.

A normally closed contact of the X locked limit switch 584 is connected to a first input terminal of an optical isolator 325 through the series combination of a diode 326 and a resistor 327. A normally closed contact of the Y locked limit switch 603 is connected to a first input terminal of an optical isolator 329 through the series combination of a diode 330 and a resistor 331. A normally closed contact of the fixed pivot limit switch 317 is connected to a first input terminal of an optical isolator 333 through the series combination of a diode 334 and a resistor 335. A normally opened contact of the pivot locked limit switch 83 is connected to a first input terminal of an opical isolator 337 through the series combination of a diode 338 and a resistor 339. A contact of the trigger switch 321 is connected to a first input terminal of an optical isolator 341 through the series combination of a diode 342 and a resistor 343. A contact of the safety swtich 323 is connected to a first input terminal of an optical isolator 345 through the series combination of a diode 346 and a resistor 347. A second input terminal of each of the optical isolators 325, 329, 337, 341 and 345 is connected to ground.

A first output terminal of each of the opical isolators 325, 329, 333, 337, 341 and 345 is connected to a positive voltage source through a resistor 349, 350, 351, 352, 353 and 354, respectively. A second output terminal of each of the optical isolators is connected to ground. Because each of the optical isolators is responsive to one of the switches, the signal available at the first output terminal of each of the optical isolators provides a signal which is indicative of the status of the table. An X locked signal is available at the first output terminal of the optical isolator 325, a Y locked signal is available at the first output terminal of the optical-isolator 329, a fixed pivot signal is available at the first output terminal of the optical isolator 333, a $\overline{\text{pivot}}$ locked/signal is available at the first output terminal of the optical isolator 337, a $\overline{\text{trigger}}$ signal is available at the first output terinal of the optical isolator 341, and a safety switch signal $\overline{\text{SS}}$ is available at the first output terminal of the optical isolator 345.

A logic gate 356 receives both the X locked and Y locked signals. An output terminal of the gate 356 is connected to a first input terminal of a gate 358. The Y locked signal is input to the first input terminal of a gate 360. The trigger signal is inverted through an inverter 362 and input to a first input terminal of a gate 364. A second input terminal of the gate 364 receives an X-Y signal which is produced by the circuit shown in FIG. 21.

An output terminal of the gate 364 is connected to a second input terminal of the gate 358 and a second input terminal of the gate 360. An output terminal of the gate 358 is connected to an input terminal of a gate 366. An X-Y locked signal, produced by the circuit shown in FIG. 21, is input to a second input terminal of the logic gate 366. The signal available at the output terminal of the logic gate 366 is a $\overline{\text{magnetic}}$ $\overline{\text{brake}}$ $\overline{\text{unlock}}$ signal which is used as shown in FIG. 21 to operate the magnetic brake solenoids 614 and 618 (not shown).

the safety switch signal $\overline{\text{SS}}$ is input to an input terminal of a logic gate 368. The output terminal of the logic gate 364 is connected to a second input terminal of the logic gate 368. The logic gate 368 produces at its output terminal a Y unlock signal. A gate 370 receives the Y unlock signal as well as the signal produced by the logic gate 360. The gate 370 produces a signal at its output terminal which is an X unlock signal. Finally, an inverter 372 is responsve to the $\overline{\text{pivot}}$ $\overline{\text{locked}}$ signal to produce a $\overline{\text{pivot}}$ $\overline{\text{unlocked}}$ signal. The various signals produced by the circuit illustrated in FIG. 22 are used as input signals to the circuit shown in FIG. 21.

Returning to FIG. 21, the X locked and Y locked signals are input to first and second input terminals, respectively, of a gate 374. An output terminal of the gate 374 is connected to the D terminal of a flip-flop 376. The C terminal of the flip-flop 376 is connected to a circuit comprised of a pair of series connected inverters 378 and 379. The output terminal of the inverter 378 is connected to the input terminal thereof through a resistor 381. The output terminal of the inverter 379 is connected to the input terminal of the inverter 378 through a capacitor 382. The X-Y locked signal is available at a Q output terminal of the flip-flop 376 while the $\overline{\text{X-Y locked}}$ signal is available at the Q output terminal of the flip-flop 376.

The X-Y locked signal is input to a first input terminal of a logic gate 384 which receives the level signal at a second input terminal thereof. The output terminal of the gate 384 is connected to a first input terminal of a gate 386. A second input terminal of the gate 386 receives a $\overline{\text{PURS}}$ signal which is produced by a flip-flop 388. The flip-flop 388 has a set terminal S connected to ground through a resistor 389 and connected to a positive voltage source through a capacitor 390. The D and C terminals of the flip-flop 388 are also connected to the positive voltage source. The reset terminal R of the flip-flop 388 is connected to ground through a capacitor 391. The Q output terminal is connected to the reset terminal through a resistor 392. The $\overline{\text{PURS}}$ signal is available at the Q terminal of the flip-flop 388.

An output terminal of the gate 386 is connected to a first input terminal of a gate 394. The signal input at a second input terminal of the gate 394 is produced by a series of gates beginning with a gate 396 which receives at a first input terminal a signal from the optical isolator 297 (shown in FIG. 20) and the $\overline{\text{PURS}}$ signal at a second input terminal thereof. An output terminal of the gate 396 is connected to a first input terminal of the gate 398. A second input terminal of the gate 398 receives a signal $\overline{\text{LevP}}$/ which is produced by a gate 400. The gate 400 produces the $\overline{\text{LevP}}$/ signal in response to its receipt of the fixed pivot signal and the level signal. An output terminal of the gate 398 is connected to the second input terminal of the gate 394.

An output terminal of the gate 394 is connected to a first input terminal of a gate 402. A second input terminal of a gate 402 is connected to ground. An output terminal of the gate 402 is connected to a flip-flop 404. The $\overline{\text{Q}}$ output terminal of the flip-flop 404 is connected to a first input terminal of a gate 406. The gate 406 is ultimately responsible for operating the pivot lock solenoid 77 through an appropriate drive circuit 408. A diode 410 is connected across the solenoid 77. The production of the signal input to the second input terminal of the gate 406 is discussed hereinbelow.

A gate 412 receives at a first input terminal a signal produced by the optical isolator 293 and receives at a second input terminal the $\overline{\text{X-Y locked}}$ signal produced by the flip-flop 376. A gate 414 receives at a first input terminal the signal available at the output terminal of the gate 412 and receives at a second input terminal, through an inverter 416, the $\overline{\text{X-Y locked}}$ signal produced by the flip-flop 376.

A gate 418 receives at a first input terminal the $\overline{\text{X-Y locked}}$ signal and receives at a second input terminal the $\overline{\text{PURS}}$ signal. An output terminal of the gate 418 is connected to a first input terminal of a gate 420. A second input terminal of the gate 420 receives the $\overline{\text{LevP}}$/ signal produced by the gate 400.

An output terminal of the gate 420 is connected to a first input terminal of a gate 422. A second input terminal of the gate 422 is responsive to the output terminal of the gate 414. An output terminal of a gate 422 is connected to an input terminal of the gate 424. A second input terminal of the gate 424 is connected to a positive voltage source. An output terminal of the gate 424 is connected to a flip-flop 426. The $\overline{\text{Q}}$ terminal of flip-flop 426 is connected to a first input terminal of a gate 428. The gate 428 is ultimately responsible for operating the pivot unlock solenoid 70 through a pivot unlock drive circuit 430. A diode 432 is connected across the pivot unlock solenoid 70.

The signals which are input to the second input terminal of the gate 406 and the second input terminal of the gate 428 are produced by a flip-flop 434. The flip-flop 434 has a C terminal responsive to the output terminal of the gate 414, a reset terminal R responsive to the output of the gate 394, and a set terminal S responsive to the output of the gate 420. An $\overline{\text{X}}$/ signal is available at the $\overline{\text{Q}}$ terminal of the flip-flop 434 and is input to the second input terminal of the gate 406. A $\overline{\text{SURG}}$ signal is available at the $\overline{\text{Q}}$ terminal of the flip-flop 434 and is input to the second input terminal of the gate 428. The gates 406 and 428 are responsible for the operation of the pivot lock solenoid 77 and the pivot unlock 70, respectively.

The magnetic brake unlock signals and X unlock and Y unlock signals produced by the circuit shown in FIG. 22 are used to directly control their respective solenoids. Thus, the magnetic brake unlock signal is input through an inverter 436 to a magnetic brake lock drive circuit 438 for operating the magnetic brake lock solenoids 614 and 618. A diode 440 is connected across the magnetic brake lock solenoid.

In a similar fashion the X unlock solenoid 564 is operated by an X unlock solenoid drive circuit 442 responsive to the X unlock signal through an inverter 444. A diode 446 is connected across the X unlock solenoid 564. The Y unlock solenoid 588 is operated by a Y unlock drive circuit 448 which is responsive to the Y unlock signal through an inverter 450. A diode 452 is connected across the Y unlock solenoid 588.

The remainder of the circuit shown in FIG. 21 produces signals which provides an indication of whether the table is in the X-Y mode, surgical mode or whether it is level. A gate 454 receives at a first input terminal the $\overline{\text{X}}$/ signal produced by the flip-flop 434 and the $\overline{\text{pivot locked}}$ signal at a second input terminal thereof. The X-Y signal, available at an output terminal of gate 454, is input to a first input terminal of an optical isolator 456 through the series combination of an inverter 458 and a resistor 460. A second input terminal of the optical isolator 456 is connected to a positive voltage source. A first output terminal of the optical isolator 456 is connected to a positive voltage source through the series combination of a resistor 462 and a light emitting diode 464. A second output terminal of the optical isolator 456 is connected to ground. The gate 454 causes the optical isolator 456 to be operative such that a current flows through LED 464 whenever the table 10 is in the X-Y mode thus providing an indication of when the table 10 is in the X-Y mode.

A gate 466 receives at a first input terminal the $\overline{\text{SURG}}$ signal and at a second input terminal the $\overline{\text{PVT unlocked}}$ signal. An output terminal of the gate 466, at which the SURG signal is available, is connected to a first input terminal of a optical isolator 468 through the series combination of an inverter 470 and a resistor 472. A second input terminal of the optical isolator 468 is connected to a positive voltage source. A first output terminal of the optical isolator 468 is connected to a positive voltage source through the series combination of a resistor 474 and a light emitting diode 476. A second output terminal of the optical isolator 488 is connected to ground. Current flows through the LED 476 in response to the SURG signal thus providing an indication that the table 10 is in the surgical mode.

A logic gate 478 receives the level signal at a first input terminal thereof and the SURG signal produced by the gate 466 at a second input terminal thereof. An output terminal of the gate 478 is connected to a first input terminal of an optical isolator 480 through the series combination of an inverter 482 and a resistor 484. A second input terminal of the optical isolator 480 is connected to a positive voltage source. A first output terminal of the optical isolator 480 is connected to a positive voltage source through the series combination of a resistor 486 and a light emitting diode 488. A second output terminal of the optical isolator 480 is connected to ground. Current flows through the LED 488 in response to the level signal thus providing an indication that the top assembly 12 is level.

OPERATION OF THE PRESENT INVENTION

The operation of the instant invention is initially controlled by the remote control box 215. As noted above, remote control box 215 includes power switch 216, power on indicator 229, side tilt control switch 218, a Trendelenburg switch 220, level top control 222, surgical mode selector switch 224, X-Y mode selector switch 226 and raise-lower control switch 228. The horizontal displacement of top assembly 12 is controlled by means of translation controller 620 which includes rotatable safety handle switch 323 and the trigger control 321.

To initiate operation of the instant invention, the table connecting means 38 is coupled to the floor bracket 36 which condition is indicated by the fixed pivot limit switch 37. The power switch 216 is then actuated which will illuminate the power on light 229. At this point, the table 10 will automatically be in the surgical mode and the surgical mode indicator light 476 will be illuminated. It will be appreciated that when the table 10 is in the surgical mode, the X translation lock assembly 558 and the Y translation lock assembly 560 will have their respective locking shafts 574 and 600 extended so as to prevent the displacement of table top relative to the superstructure 30. The extension of X locking shaft 574 is sensed by limit switch 584 and the extension of Y locking shaft is sensed by Y limit switch 603. If the locking shafts are not extended, all functions of the surgical mode are disabled. In the surgical mode, the pivot unlock solenoid 72 will cause the blocking plunger 20 to be removed from the pin 62 so that the table 10 may be uncoupled from the floor bracket 36. If Trendelenburg or Reverse Trendelenburg displacement of the top assembly 12 is desired, the Trendelenburg control switch 220 may be rocked to the left or the right to control Trendelenburg motor 506 to cause the head end of table top 12 to be lowered or raised, respectively. In the even the tabletop 12 is to be tilted either to the right or to the left of center line, the side tilt control switch 218 is actuated to cause the tilt motor 516 to tilt the tabletop 12 relative to the superstructure 30. If table top 12 has been tilted either laterally or in the Trendelenburg mode, the top leveling control switch 222 may be actuated to cause the tilt motor 516 and the Trendelenburg motor 506 to return the top assembly 12 to a level condition and the level top indicator 488 will be illuminated. At any time during operation in the surgical mode, the raise-lower control switch 228 may be actuated to cause motor 26 to power pump 24 to raise and lower yoke 22 by means of hydraulic cylinder 23 and under the control of solenoids 305 and 309, respectively.

In the event the X-Y mode is to be employed, the top leveling control switch 222 must first be actuated to return the top assembly 12 to a level condition thereby illuminating the level top indicator 488. Thereafter, the X-Y control switch 226 may be actuated thereby illuminating the X-Y mode indicator 464. The actuation of the X-Y control switch 226 disables the tilt switch 218 and the Trendelenburg switch 220 and causes the blocking plunger 70 to be extended by the pivot lock solenoid 77 so as to lock the base 14 of the table to the floor bracket 36. The actuation of the X-Y control switch 226 also enables translation control by engaging the translation controller 620. If horizontal displacement of top assembly 12 is desired, safety switch 323 must first be rotated which causes the release of the X lock assembly 558 and the Y lock assembly 560 by the retraction of X translation locking shaft 574 by the operation of X unlock solenoid 564 and Y translation locking shaft 600 by the operation of Y unlock solenoid 588, respectively. The top assembly 12 will not, however, be moved relative to superstructure 30 until trigger 321 is actuated so as to release the magnetic brakes 612 and 616. Once top assembly 12 is moved away from the longitudinal home position, rotation of safety switch 323 is no longer required for horizontal translation. This is because the Y lock limit switch 603 senses and generates a signal indicating that the Y locking shaft 600 is not extended. This signal causes X unlock solenoid 564 to be controlled by trigger switch 321. As the second locking shaft 600 will ride on channel 554 during horizontal translation, only the actuation of trigger 321 is then required to horizontally displace the top assembly 12 by releasing the X lock solenoid 564 and magnetic brakes 612 and 616. It is necessary that the X unlock solenoid 564 remain energized to retract X locking shaft 574 because if solenoid 564 was not energized, locking shaft 574 would be extended and could abruptly enter receptacle area 581 if receptacle area 581 was passed over an extended locking shaft 574.

If the top assembly 12 is not physically moved away from the home position after rotating switch 323 and pulling trigger 321, the top assembly 12 will relock into the home position, the X limit switch 584 and Y limit switch 603 will sense that condition, and the controls will reset from the X-Y mode to the surgical mode. If the top assembly 12 has been displaced relative to the superstructure 30 and it is desired to return the surgical mode, the trigger 321 is activated and the top assembly 12 is translated to its longitudinal stop which s the longitudinal component of the home position. This action causes locking shaft 600 to enter notch 610 on channel 554 to actuate limit switch 603. This action ends the control of X solenoid 564 by trigger 321 so that X locking shaft 574 is extended. Top assembly 12 is then translated laterally to the center position in order that locking shaft 574 may enter the recessed area 581 on receptacle plate 580 to lock the table in the X direction and actuate limit switch 584. Once the table assembly 12 is locked in the home position, the table 10 controls are reset automatically to the surgical mode. As noted above, the selfleveling control switch 222 may be actuated in the X-Y mode to return the top assembly 12 to level in the event a cantilever load has caused the displacement thereof.

It will be appreciated that the instant invention provides a much needed tool for the medical field. Either surgical operations may take place on table 10 or table 10 may be employed in connection with radiographic procedures without requiring the relocation of a patient from one theater to another.

It will be understood that various changes in the details, materials and arrangements of parts which have been herein described and illustrated in order to explain the nature of the invention may be made by those skilled in the art within the principal and scope of the invention as expressed in the appended claims.

What is claimed is:

1. A surgical table comprising:

a. an elongated tabletop formed of a radioluscent material and having a patient support surface, said surface having a longitudinal axis and a lateral axis;

b. a base member;

c. means attached between said tabletop and said base for movably supporting said tabletop on said base member including:

(i) means for tilting said tabletop about said longitudinal axis and said lateral axis; and (ii) translation means for supporting said tabletop so that it is manually translatable relative to said base member along both said longitudinal and lateral axes;

d. locking means which, when activated, prevents the translation of said tabletop relative to said base member and which, when deactivated, allows the translation of said tabletop relative to said base member;

e. disabling means which, when activated, prevents the tilting of said tabletop about said longitudinal axis and said lateral axis and which, when deactivated, allows the tilting of said tabletop about said longitudinal axis and said lateral axis; and f. control means for simultaneously activating said locking means and deactivating said disabling means and for simultaneously activating said disabling means and deactivating said locking means.

2. The surgical table of claim 1 in which said control means further comprises means for preventing the deactivation of said locking means when said tabletop is not horizontally level.

3. The surgical table of claim 1 further comprising means for automatically horizontally leveling said tabletop.

4. The surgical table of claim 3 in which said means for leveling comprises control means operatively connected to said tilting means to cause said tilting means to move said tabletop to a horizontally level position.

5. The surgical table of claim 1 further comprising:

a. a floor-mounted bracket which is pivotable about a vertical axis;

b. attachment means mounted on said base member for releasably attachingly engaging said floor-mounted bracket; and c. means for prohibiting the release of said attachment means from said engagement means when said locking means is activated.

6. The surgical table of claim 1 in which said means is movably supporting further comprises means for raising and lowering said tabletop relative to said base member.

7. The surgical table of claim 1 in which said tilting means are electromechanically actuated.

8. The surgical table of claim 1 in which said base member comprises:

a. a plurality of support legs for engaging a floor;

b. a plurality of wheels which may be extended from said base member to engage a floor such that when said wheels engage said floor, said support legs do not engage said floor.

9. The surgical table of claim 1 in which said tilting means may be manually actuated.

* * * * *

UNITED STATES PATENT AND TRADEMARK OFFICE

CERTIFICATE OF CORRECTION

PATENT NO. : 4,761,000

DATED : August 2, 1988

INVENTOR(S) : Kenneth J. Fisher et al.

It is certified that error appears in the above-identified patent and that said Letters Patent is hereby corrected as shown below:

Col. 1, line 21, cancel "may" and substitute therefor --many--.

Col. 5, line 41, cancel "assembly1 2," and substitute therefor --assembly 12,--.

Col. 7, line 35, cancel "502" and substitute therefor --503--.

Col. 9, line 63, cancel "alternate" and substitute therefor --alternative--.

Col. 13, line 49, cancel "318" and substitute therefor --317--.

Col. 13, line 68, cancel "opical" and substitute therefor --optical--.

Col. 14, line 5, cancel "swtich" and substitute therefor --switch--.

UNITED STATES PATENT AND TRADEMARK OFFICE

CERTIFICATE OF CORRECTION

PATENT NO. : 4,761,000

DATED : August 2, 1988

INVENTOR(S) : Kenneth J. Fisher et al.

It is certified that error appears in the above-identified patent and that said Letters Patent is hereby corrected as shown below:

Col. 14, line 9, after "329, " insert --333, --.

Col. 14, line 10, cancel "opical" and substitute therefor --optical--.

Col. 14, line 23, cancel "locked/signal" and substitute therefor --$\overline{\text{locked}}$/signal--.

Col. 14, line 48, cancel "the" and substitute therefor --The--.

Col. 15, line 2, cancel "X-Y locked" and substitute therefor --$\overline{\text{X-Y locked}}$--.

Col. 15, line 20, cancel "Q" and substitute therefor --$\overline{\text{Q}}$--.

Col. 15, line 30, cancel "$\overline{\text{Lev}}$P/" and substitute therefor --$\overline{\text{Lev/FP}}$--.

UNITED STATES PATENT AND TRADEMARK OFFICE

CERTIFICATE OF CORRECTION

PATENT NO. : 4,761,000

DATED : August 2, 1988

INVENTOR(S) : Kenneth J. Fisher et al.

It is certified that error appears in the above-identified patent and that said Letters Patent is hereby corrected as shown below:

Col. 15, line 31, cancel "$\overline{\text{Lev}}$P/" and substitute therefor --$\overline{\text{Lev/FP}}$--.

Col. 15, line 58, cancel "$\overline{\text{Lev}}$P/" and substitute therefor --$\overline{\text{Lev/FP}}$--.

Col. 16, line 11, cancel "$\overline{\text{X}}$/" and substitute therefor --$\overline{\text{X-Y}}$--.

Col. 16, line 37, cancel "provides" and substitute therefor --provide--.

Col. 16, line 40, cancel "$\overline{\text{X}}$/" and substitute therefor --$\overline{\text{X-Y}}$--.

UNITED STATES PATENT AND TRADEMARK OFFICE

CERTIFICATE OF CORRECTION

PATENT NO. : 4,761,000

DATED : August 2, 1988

INVENTOR(S) : Kenneth J. Fisher et al.

It is certified that error appears in the above-identified patent and that said Letters Patent is hereby corrected as shown below:

Col. 18, line 51, cancel "which s" and substitute therefor --which is--.

Col. 20, line 23, cancel "is" and substitute therefor --for--.

Signed and Sealed this

Seventh Day of February, 1989

*Attest:*

DONALD J. QUIGG

*Attesting Officer*

*Commissioner of Patents and Trademarks*